United States Patent [19]

Trevett et al.

[11] Patent Number: 5,047,760

[45] Date of Patent: Sep. 10, 1991

[54] CROSSBAR CONVERTER

[75] Inventors: Neil F. Trevett, Kingston upon Thames, United Kingdom; Malcolm E. Wilson, Bridport, England

[73] Assignee: DuPont Pixel Systems Limited, Weybridge, England

[21] Appl. No.: 297,002

[22] Filed: Jan. 13, 1989

[30] Foreign Application Priority Data

Mar. 23, 1988 [GB] United Kingdom ..... 8806872
Mar. 23, 1988 [GB] United Kingdom ..... 8806875
Mar. 23, 1988 [GB] United Kingdom ..... 8806878

[51] Int. Cl.[5] ..... G09G 5/00
[52] U.S. Cl. ..... 340/799; 340/798
[58] Field of Search ..... 340/798, 799, 721, 744, 340/747

[56] References Cited

U.S. PATENT DOCUMENTS 4,092,728 5/1978 Baltzer .
4,533,910 8/1985 Sukonick et al. ..... 340/721
4,642,621 2/1987 Nemoto et al. ..... 340/721
4,663,729 5/1987 Matick et al. ..... 340/798
4,692,757 9/1987 Tsuhara et al. ..... 340/721
4,710,767 12/1987 Sciacero et al. ..... 340/799
4,755,810 7/1988 Knierim ..... 340/799
4,816,815 3/1989 Yoshiba ..... 340/799
4,845,480 7/1989 Satou ..... 340/799
4,845,640 7/1989 Ballard et al. ..... 340/798

FOREIGN PATENT DOCUMENTS 99989 2/1984 European Pat. Off. .
196733 10/1986 European Pat. Off. .

*Primary Examiner*—Jeffery A. Brier
*Attorney, Agent, or Firm*—Sterne, Keeler, Goldstein & Fox

[57] ABSTRACT

A crossbar converter to format 32 bit raster formatted I/O data into 5×4 patch formatted eight bit pixel data enables a 160 bit wide pixel data bus to be used so as to attain a high bandwidth for I/O devices. By using the wide pixel data bus and patch format for I/O, the facilities of the an screen memory and an arbitrary shape clipper can be made available to process a real time video window on a high resolution, bit mapped display monitor. The crossbar converter can be used to convert the parallel input of standard I/O devices into patch format, (five by four by eight, for example). The thus converted I/O data may be used by an off screen memory and an arbitrary shape clipper at high transfer rates.

9 Claims, 16 Drawing Sheets

$\overline{\text{buffer enable}}$ = X Counter Read Enable + Y Counter Read Enable MUX Select = X Counter Read Enable + X Counter Load Enable

CROSSBAR CONVERTER

I. BACKGROUND OF THE INVENTION a. Field of the Invention

The present invention relates to the field of window and image management on computerized imaging and graphics display systems., and to image storage systems and methods.

b. Related Art

In computer imaging and graphics systems it is often necessary or desirable to have several different related or unrelated images displayed and being processed on the video monitor simultaneously.

For example, in the architecture field it may be useful to display several different views of an object at the same time. In the field of simulated training, several objects, displays and program outputs may need to be visible to the trainee simultaneously in order to simulate a real world environment.

In order to accomplish simultaneous display of images, computer systems utilize a concept known as windowing. Each window on the display screen acts as a viewport for an image. The image appearing in each viewport may be controlled by a separate process, executed through an operating system.

In conventional computer systems a number of rectangular shaped windows may be displayed simultaneously and arranged arbitrarily on the monitor. Some windows may appear side-by-side while others may overlap. Operations such as "pan" and "zoom" may also be performed on some windows but not on others. An example of a graphics display system utilizing windowing techniques is shown in U.S. Pat. No. 4,533,910, to Sukonick et al., entitled GRAPHICS DISPLAY SYSTEM WITH VIEWPORTS OF ARBITRARY LOCATION AND CONTENT, which is hereby incorporated by reference in its entirety as if set forth in full below.

The manipulation and management of windows present many problems for the computer programmer and designer. Many conventional imaging and graphics systems display two or more overlapping windows. When this occurs, the window(s) appearing in the foreground may partially obscure a portion of the window(s) appearing in the background.

In order for windows to appear overlapped, the image in the background window must be "clipped" to the contours of the unobscured (visible) portion. A conventional way to clip images to the contours of a window is by a software application which splits the unobscured portion into "tiles" (rectangular shaped pieces). Whenever an operation is performed in the window, it is clipped against each tile in turn so that the displayed image appears only in the unobscured portion of the window.

When the foreground window is subsequently moved or deleted, the background window must be repaired to resume its original shape and content. A conventional solution to this problem is to retain in memory a "display list" of the operations necessary to recreate the obscured portion of the window, and to rerun these operations when the overlap is removed.

While the tile clipping and rerunning of the display list allows for recreation and repair of the window, it is time consuming both in terms of visual effect and processor loading. Further, the tile clipping/display list technique can be difficult or even impossible to manage if complex images and operations are involved. This is particularly true if the operations involve real time images input from a camera or other video source.

While hardware solutions, such as those disclosed in U.S. Pat. No. 4,642,621, to Nemoto et al., have been published, these conventional solutions limit the clipped area to a rectangular shape. See, U.S. Pat. No. 4,642,621 to Nemoto et al, entitled IMAGE DISPLAY SYSTEM FOR COMPUTERIZED TOMOGRAPHS, which is hereby incorporated by reference in its entirety as if it were set forth in full below.

An alternative method which might be considered for achieving a windowed display is to use video rate selection of image data from the video data output of the screen refresh memory during display. Whilst this method would allow efficient manipulation of displayed windows, it suffers from several drawbacks. First, as the resolution of display monitors increases, it is becoming more difficult to calculate and manipulate the data at video rate. Secondly, it is a complex problem to select arbitrary pixels for display during the active line time with an image memory made with video RAMs. Thirdly, as it is usually necessary to be able to display data from any part of the screen refresh memory, the entire memory must be dual ported; this results in an inherent increase in cost. If it is required to be able to manipulate many full screen sized images, the cost of a dual ported image memory can become detrimental and even prohibitive.

It would be highly desirable to have a fast and efficient alternative to video rate window processing and to be able to perform window clipping and repair operations quickly and with minimalized CPU loading. It would also be useful to have a window management system which can handle involved operations without the need for complex or exotic software algorithms. Additionally, it would be very desirable to be able to clip an image to a window of any arbitrary shape.

It should be understood that the term "image" is sometimes used in the art to mean a picture defined from data acquired from a real object, while a "graphic" is sometimes used to refer to a synthetic or programmed picture. For the purposes of this application, the term image is used in the broad sense, and refers to any picture, regardless of how it is generated, and regardless of the source from which the data is derived.

Several books are available which teach concepts such as clipping, windowing and graphics processing in general. Excellent discussions of these and other related concepts can be found in the following books: *Principles of Interactive Computer Graphics* (second edition), authors William M. Newman and Robert F. Sproul, (McGraw Hill Publishing Company, 10th printing, New York, 1984); *COMPUTER GRAPHICS—A Programming Approach*, author Steven Harrington, (McGraw Hill Publishing Company, 1st Printing, New York, 1983); *Computer Graphics*, authors Donald Hearn and M. Pauline Baker, Prentice-Hall International (UK) Limited (1986). All of the above named books are, in their entirety, incorporated by reference herein as if each were set forth in full below.

II(A). SUMMARY OF THE INVENTION

The present invention comprises a system and method for formatting parallel image date into an array. In the preferred embodiment, the system uses a plurality of fifos and multiplexers under control of a state machine to take 32 bit parallel raster scan data and format it into arrays of 5×4 eight bit pixels.

II(B) FEATURES AND ADVANTAGES

The inventors have discovered systems and methods that provide new solutions to many complex window management and image manipulation problems. Several embodiments of these systems and methods utilize an off screen memory.

(i) Simultaneous Off Screen Memory

The off screen memory of the present system and method is to be distinguished from alternative architectures that use a frame memory and a program memory which are mapped into different address areas. Unlike the alternative architecture, the off screen memory of the present system can be addressed in the same manner and with the same pixel address data as the screen refresh memory. The off screen memory of the present system and method can also simultaneously access the same image data as the screen refresh memory. Many other differences and distinguishing features will also become apparent throughout this specification.

In some embodiments, the off screen memory enables fast and easy repair and movement of windows. In other embodiments, the off screen memory provides a buffer for a real time video input. In still other embodiments, the off screen memory can be used for image manipulation and warping.

(ii) Flexible Source and Destination Control

By utilizing an innovative flexible source and destination control, the system and method can accomplish many significant tasks with remarkable speed and ease. Any number of off screen and screen refresh memories can share the system and methods common image data bus. Independent read and write controls allow data to be transferred on this bus, in any direction, between any memory or other source and other memory, group of memories or other destination.

One result of this flexible control is that the off screen memory can receive a simultaneous (mimic) copy of image data as it is written to the screen refresh memory. Further, image data can be quickly transferred in either direction between the screen refresh memory and the off screen memory with or without being read or manipulated by a graphics processor.

Broadly, the system and method's flexible source and destination control can be used to route image data in either direction between a processor, I/O device, or other source and any combination and number of the off screen and screen refresh memories. This is highly useful for applications such as image warping where the flexible source and destination control of the present system and method can be used to maintain an archival copy of an image to be warped.

(iii) Image Warping

The advantages of the flexible source and destination control of the present system and method can be demonstrated by way of an image warping example. Using the present system and method, when the image is first written to the screen refresh memory it is also routed to the off screen memory. The off screen memory can then be write disabled, and the image in the screen refresh memory can be warped or otherwise manipulated.

Advantageously, the flexible source and destination control of the present system and method enables the systems graphics processor to read the image data stored in either of the screen refresh or off screen memories. This means that a displayed image can be rewarped by having the graphics processor read the unwarped data from the off screen memory, perform calculations on the unwarped image data and send the newly warped image out to the screen refresh memory only. This significantly speeds up image warping and similar techniques because it is much simpler to warp and unwarped image then it is to recalculate the pixel data for an already warped image.

Further, when it is desired to display the unwarped image, the flexible source and destination control of the present system and method enables the graphics processor to perform a high speed block copy between the off screen and screen refresh memories. Warping is, of course, just one example of how the flexible source and destination control of the present system and method can be utilized.

(iv) Independent Address Generation and XY Offset Logic

Several embodiments are also designed with XY offset and independent address generation logic. The inventors have discovered systems and methods of offsetting commonly provided address data which can be utilized to greatly increase window management speeds. The XY offset and independent address generation of the present system and method enables the off screen memory to transparently maintain a complete and unobscured version of each window on the display screen in any off screen address area, even when an window is partially or completely overwritten in the screen refresh memory.

Utilizing the present system and method, an initial window offset value can be calculated by the graphics processor using an offset algorithm and downloaded to XY offset logic on the off screen memory. Alternatively, the previous window offset data can be stored and reused by the XY offset logic.

By using fast copy logic in conjunction with the XY offset logic, the system and method can repair and move windows almost instantaneously. When an image is fast copied from the off screen memory to the screen refresh memory, the XY offset logic provides automatic address translation so that the image appears on the desired portion of the display screen. Further, when data flows in either direction relative to the off screen memory the XY offset logic can perform image address translation in hardware, invisibly to the software application program. A fast copy from the off screen memory can also be used to instantly move a window or restore a window to full form when an obscuring window is moved or deleted. Further, the off screen image may be used as a reference to provide complete image data irrespective of any corruption, overwriting or manipulation of the displayed image.

The connotations of this flexible system and method are quite substantial. For example, the off screen memory can be operated so as to mimic a changing on screen image while automatically translating it into an address area that is different from that at which it is stored in the screen refresh memory. This allows the off screen memory to store complete copies of a number of visually overlapping windows even though overlapped portions of background windows are no longer in the image memory. These complete window copies can be utilized to move, reconstruct, process or manipulated the windows or any portion of the image data within. This enables partial, manipulated or corrupted on screen image windows to be operated on based on the complete off screen data. The system and method is also cost efficient in that it enables video RAMs to be used for the screen refresh memory, whilst also allowing single ported rams to be used to hold undisplayed data.

(v) Arbitrary Shape Clipper

The inventors have also discovered an innovative and flexible system and method for image clipping. This system and method, (the Arbitrary Shape Clipper), can be used to clip an image to complex contours more quickly than many prior systems can clip to even a simple rectangle. The system and method also reduces image clipping time and allows for complex window management.

Several embodiments of this system and method include a random access memory (RAM) (the clipper memory) which is used to store a bit mapped pattern defined by the shape of the non-obscured portion of a displayed window. This pattern is used to automatically clip an image to the contours of the non-obscured portion of the window by write disabling the screen refresh memory for addresses corresponding to any obscured portions of the active window. Advantageously, the use of a RAM stored, bit mapped pattern allows an image to be clipped, almost instantaneously, to even arbitrary and complex contours.

A further distinguishing and remarkable feature of several system and method embodiments is that the clipping patterns can be automatically updated. This is particularly useful when a new window is written to the screen refresh memory, when a window is moved from the background to the foreground or in other cases where the shape of the displayed portion of a window is modified. By using the same addresses that are used to write to the screen refresh memory, the present system can write a bit map pattern of a new or moved window into its clipper memory and at the same time update the bit map patterns of the other displayed windows whilst the screen itself is being initialized.

(vi) High Bandwidth I/O on an Image Data Bus

The inventors have also discovered a system and method of making the substantial abilities of the off screen memory and arbitrary shape clipper available to external sources such as I/O devices. By putting I/O data on the image data bus with the simultaneous on screen and off screen memories and arbitrary shape clipper of the present system and method, these resources can be made available on a real time basis. For example real time windows can be created on the displayed screen and the images clipped enroute.

(vii) Crossbar Converter

Advantageously, several embodiments of the system and method can perform real time reformatting of externally provided data so as to organize it into an efficient two dimensional format (a patch). In several embodiments, the system and method utilizes a 160 bit wide image data bus to achieve high bandwidths. These high bandwidths can also be made available to I/O devices.

(viii) Real Time Image Buffering

Advantageously, the above described systems and method can work in conjunction with each other to provide a versatile image management system. In this regard, the inventors have discovered systems and methods of utilizing the off screen memory as a real time frame buffer. For example, typical high resolution bit mapped monitors display at 60 Hz non-interlaced, while typical cameras at 25-30 Hz Interlaced. The present system can be used to resolve this problem by copying data from camera into the off-screen memory at the camera rate, and double buffering by block copying only complete images from the off screen memory onto the screen (normally in sync with the display rate). In this manner, a high quality, real time window can be generated.

Advantageously, video rate window processing is not required for any of these systems and methods.

III. BRIEF DESCRIPTION OF THE DRAWINGS

The present invention may be better understood by reference to the following drawings.

Figure 1:
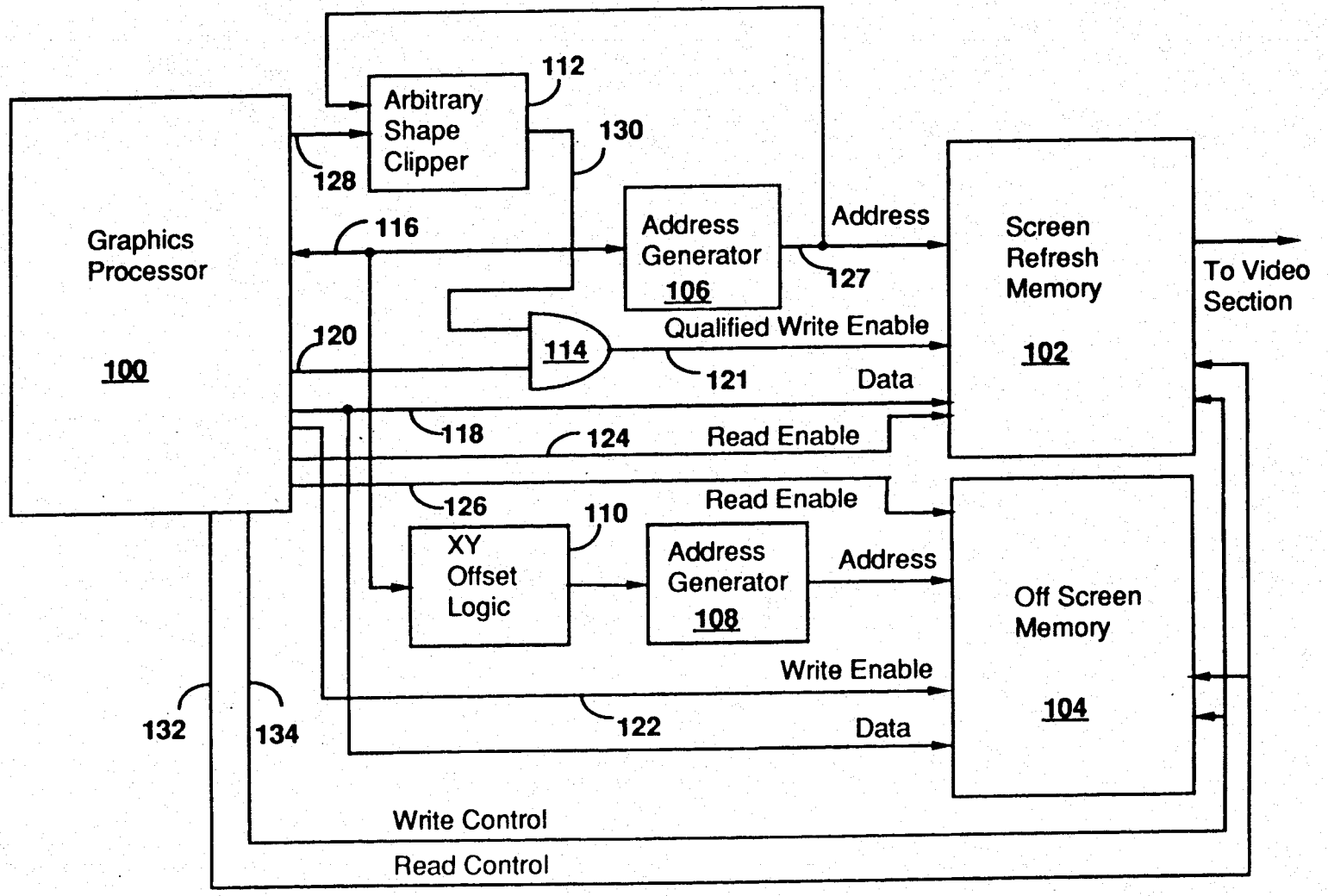
FIG. 1 is a generalized block diagram of an embodiment of the system and method of the present invention showing the off screen memory and arbitrary shape clipper in an imaging and graphics processing environment.

IV. DETAILED DESCRIPTION OF THE PREFERRED EMBODIMENTS a. Overview

The present invention comprises a system and method for performing image and window management using hardware. In a preferred embodiment, the system and method of the present invention includes several subsystems which contribute towards fast and efficient window management.

In one embodiment, the system and method of the present invention makes use of simultaneous screen refresh and off screen memories 102, 104, which have the ability to perform image address translation and/or high speed copy operations. The simultaneous screen refresh and off screen memories 102, 104 enable the system and method of the present invention to keep a complete copy of every image window in the display monitor (not shown) even under circumstances where one window overlaps another.

In another embodiment, a RAM based arbitrary shape clipper 112 is provided so that image data may be clipped automatically to any arbitrary shape without the use of manipulative software.

A further embodiment of the system and method of the present invention includes both the RAM based arbitrary shape clipper 112 and the simultaneous screen refresh and off screen memories 102, 104. The system and method of the present invention can also make use of an I/O crossbar converter 800 so that windows may be displayed directly from an input device (not shown) such as a camera.

These subsystems of the present invention share in common the use of a pixel data bus 118. This is preferably a 160 bit wide bus that is used to carry pixel information for a group of twenty pixels, each pixel being defined by eight bits of information. The groups of pixel data are preferably organized into an array of five pixels in the horizontal by four pixels in the vertical direction. This group of five by four pixels will be referred to as a patch. A display screen may be considered as being made up of these rectangular patches.

In a typical high resolution display monitor (not shown), there are 1280 pixels in each horizontal row and 1024 pixels in each column. The screen would therefore be covered by an array of 256 by 256 patches, each patch consisting of five pixels in the horizontal direction and four pixels in the vertical direction. Patch processing facilitates the use of technical features which greatly increase the bandwidth of the system and method. Although a five by four patch of eight bit pixels is preferred, it should be understood that the present invention may function with patches of any size, including one by one (i.e. a single pixel) with each pixel being defined by any number of bits.

b. Simultaneous On-screen and Off-screen Memories

One embodiment of the present system includes an off screen memory 104. The off screen memory 104 can be used to automatically store a complete copy of image data simultaneously with the image data being written to the screen refresh memory 102. The preferred architecture of the simultaneous On-screen and Off-screen memory system of the present invention may be better understood by reference to FIG. 1.

FIG. 1 shows a graphics processor 100, a screen refresh memory 102, an off screen memory 104, a screen refresh memory address generator 106, an off-screen memory address generator 108, off-screen memory XY offset logic 110, an arbitrary shape clipper 112, and an "AND" gate 114.

The graphics processor 100 is essentially a bit slice central processing unit, which has been designed to optimally perform standard imaging and graphics functions. Graphics processors are known in the art and are also often referred to as graphics controllers.

The graphics processor 100 supplies control and data signals to the system and method of the present invention. These include the address data bus 116, the pixel data bus 118, a screen refresh memory write enable line 120, an off screen memory write enable line 122, a screen refresh memory read enable line 124, an off screen memory read enable line 126, read and write control lines 132, 134, and arbitrary clipper control lines 128.

It is preferred that the graphics processor be designed with the ability to read back data from the address data bus 116 (i.e. that it can transfer data bidirectionally on this bus). The preferred graphics processor is a Du Pont Pixel Systems GIP, available from Du Pont Pixel Systems Limited (formerly benchMark Technologies Limited), 5 Penrhyn Road, Kingston-upon-Thames, Surrey KT1 2BT, England. However, any suitable graphics processor can be used in or with the present invention.

The pixel data bus 118 is preferably a 160 bit wide bus. In order to accelerate the data transfer rate, the pixel data is preferably accessed in patches. As may be seen from FIG. 1, the pixel data bus 118 is shared by the screen refresh memory 102 and the off screen memory 104 so that any data accessible by one memory will also be accessible by the other.

The screen refresh memory 102 and the off-screen memory 104 have separate write enable lines 120, 122 so that the graphics processor 100 can cause pixel data to be written to either, neither, or both of the screen refresh and off-screen memories. The screen refresh memory 102 and the off screen memory 104 also have separate read enable lines 124, 126, respectively, as well. Only one of the memories 102, 104 may be read enabled at a given time.

The screen refresh memory write enable line 120 is logically "ANDed" with the output of the arbitrary shape clipper 112 at the "AND" gate 114 so as to generate a qualified write enable signal (on line 121) for the screen refresh memory. The purpose of the "AND" gate 114 will be explained in detail within the "arbitrary shape clipper" section of this specification below. The off-screen memory write enable line 122 is used directly by the off screen memory. The read and write enable signals qualify the actual read and write control signals sent from the graphics processor 100 directly to both memories 102, 104 via the read and write control lines 132, 134.

The screen refresh and off screen memories 102, 104 have identical functionality from the viewpoint of the graphics processor 100, excepting that only the screen refresh memory 102 can be displayed, and the memories are potentially of different sizes. This allows the selection of source and destination memories 102, 104 to be made invisibly to the software of graphics processor 100. Whatever operations can be performed in the screen refresh memory 102 can also be performed in the off screen memory 104. These shared capabilities typically include: plane masking, page mode accesses, and selective pixel write masking within a patch for a patch based processor.

The screen refresh memory 102 is preferably a dual ported video RAM based memory. This memory is used to refresh the image on the screen of the display monitor. Those skilled in the art will appreciate that one port of the screen refresh memory will be used to read and write image data, while the other port will be used to form the image that is observed on the video display monitor.

The presently preferred embodiment of the system and method of the present invention presumes that the refresh memory is bit-mapped to a high resolution screen of 1280×1024 pixels. The preferred screen refresh memory is a Du Pont Pixel Systems bFs framestore, available from Du Pont Pixel Systems Limited, 5 Penrhyn Road, Kingston-upon-Thames, Surrey KT1 2BT, England. It should be understood, however, that suitable frame store can be used.

The off screen memory 104 is preferably designed using dynamic RAMs, but other memory devices may be used to accommodate access time and other design considerations. Both the screen refresh memory 102 and the off screen memory 104 are preferably designed to be two dimensionally addressable by using the Row Address Strobe (RAS) lines to provide the X addressing and the Column Address Strobe (CAS) lines to provide the Y addressing.

The preferred off screen memory 104 is a Du Pont Pixel Systems bFx framestore extension, available from Du Pont Pixel Systems Limited, 5 Penrhyn Road, Kingston-upon-Thames, Surrey KT1 2BT, England.

The address data bus 116 should be at least wide enough to access each memory location of either the screen refresh memory or the off-screen memory—whichever is larger. If the memory is addressed in two dimensions, it is only necessary for the address data bus 116 to be wide enough to carry an X or Y address in systems where only one component of the address can be loaded at a time.

In an embodiment tested by the inventors, the address data bus 116 was 16 bits wide; however, addresses loaded into the address generators 106, 108 and XY offset logic 110 were converted to 12 bit addresses. The Y addresses used the bottom 12 bits of the 16 bit address data bus value. The X addresses used the entire 16 bit address data bus value, passed through a modulo 5 conversion PROM, to account for the 5 by 4 patch geometry, thus producing 12 output bits. The modulo 5 converter can be eliminated where patches are not used, or where each patch dimension is a power of two.

It is preferred that the off screen memory 104 be larger than the screen refresh memory 102. The off screen memory 104 should be large enough to accommodate the maximum number of windows that are likely to be opened on the screen at any one time.

In one embodiment tested by the inventors, the screen refresh memory 102 was (1280×1024) bytes. The off screen memory 104 was designed to accommodate (8×(1280×1024)) bytes. The inventors have discovered that having the off screen memory be larger than the screen refresh memory by a factor of eight is sufficient to accomplish most functions. Advantageously, by making the off screen memory 104 larger than the screen refresh memory 102, the complete windows stored in the off screen memory can be any size; not necessarily the same size as the screen. They can be smaller, equal to, or larger than the screen size. Further, the larger offscreen memory 104 allows for operations such as animation to be accomplished by performing a series of fast copies from various portions of the off screen memory to a window in the screen refresh memory. It may be observed that the number of complete windows that may be stored will increase with the size of the off screen memory. The address data bus 116 is shared in common by the screen refresh memory address generator 106 and the off screen memory XY offset logic 110.

Figure 10:
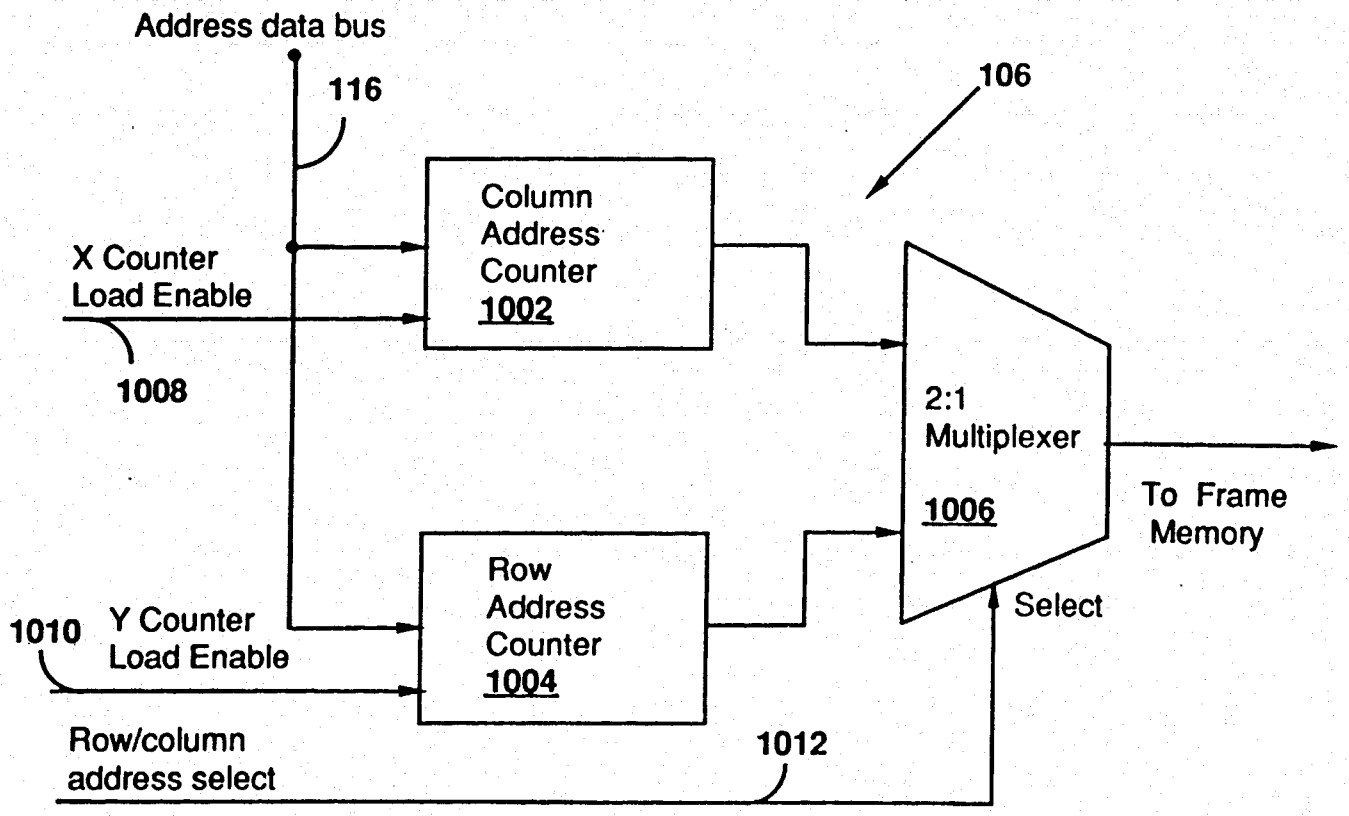
FIG. 10 is a block diagram of an embodiment of the screen refresh memory address generator 106 of the present invention.
Figure 11:
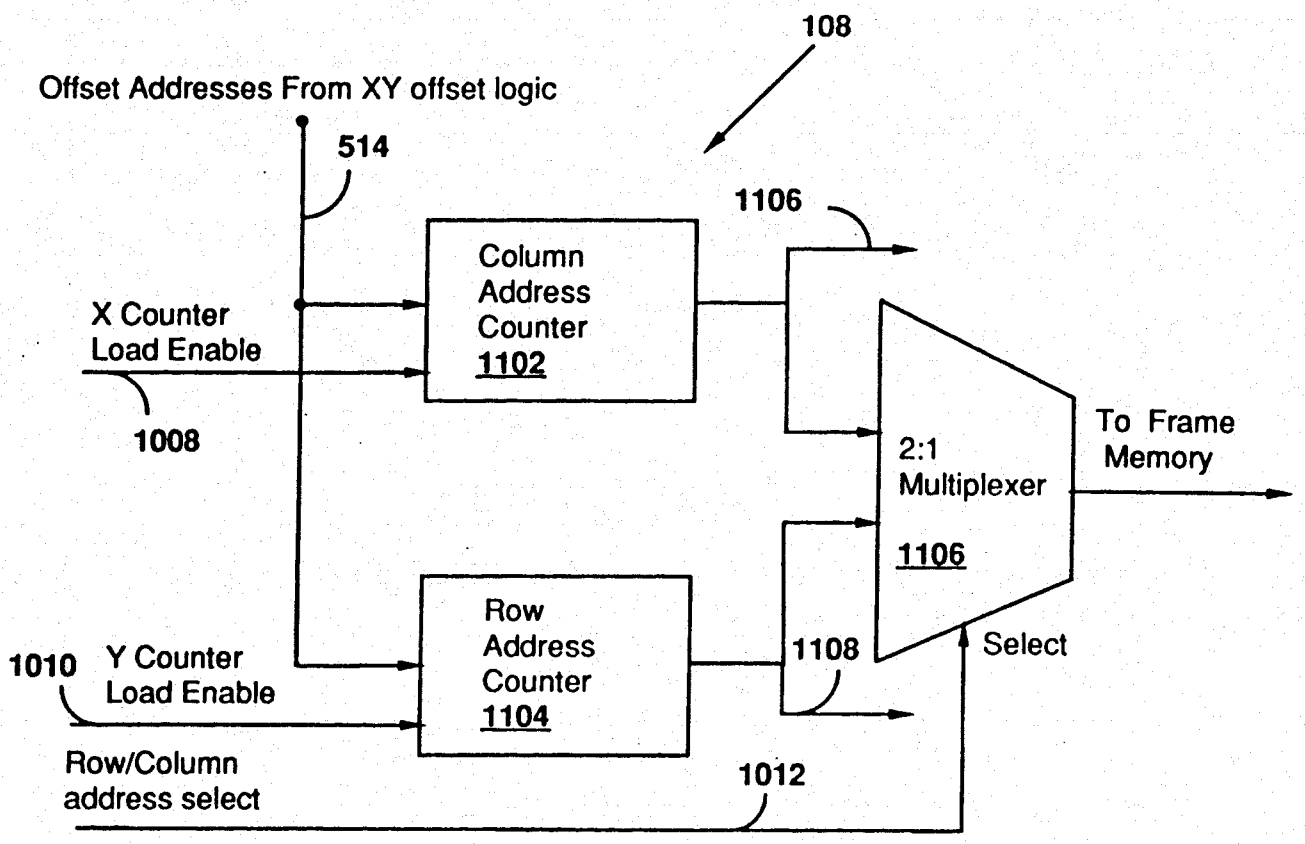
FIG. 11 is a block diagram of an embodiment of the off screen memory address generator 108 of the present invention.

The address generators 106, 108 are of a type used for generating addresses for two dimensionally addressed memories such as the screen refresh and off screen memories. The address generators utilize separate counters 1002, 1004 (FIG. 10) 1102, 1104 (FIG. 11) to hold both the X and Y addresses for the image memory. By counting one or both of the counters, the currently addressed position in the image memory can be easily moved in two dimensions.

In the embodiment tested by the inventors, the counters were 12 bits wide to account for the organization of the address data bus. The graphics processor 100 can initialize the counter values at any time from the address data bus 116 (indirectly through the XY offset logic in the case of the Off Screen Memory Address Generator 108).

To allow the off screen memory to mimic the displayed memory it is necessary that both address generators 106, 108 are loaded and counted together. The Graphics Processor 100 provides several control signals related to memory addressing. These are the X counter load enable 1008 (used to load the Column Address Counters 1002,1102 within the memory address generators 106,108), the Y counter load enable 1010 (used to load the Row Address Counters 1004,1104 within the memory address generators 106,108), and the Row/-Column address select 1012 (used to select between the column and row addresses, and also used as Row and Column address timing signals by the screen refresh and off screen memories 102, 104).

Linear addressing schemes may be used for the screen refresh and off screen memories although this configuration is less desirable in an image and graphics processing environment. Where linearly addressable memories are used, the graphics processor 100 or other CPU may be used to provide the memory address lines directly. In this case the address generators may be eliminated.

Figure 5:
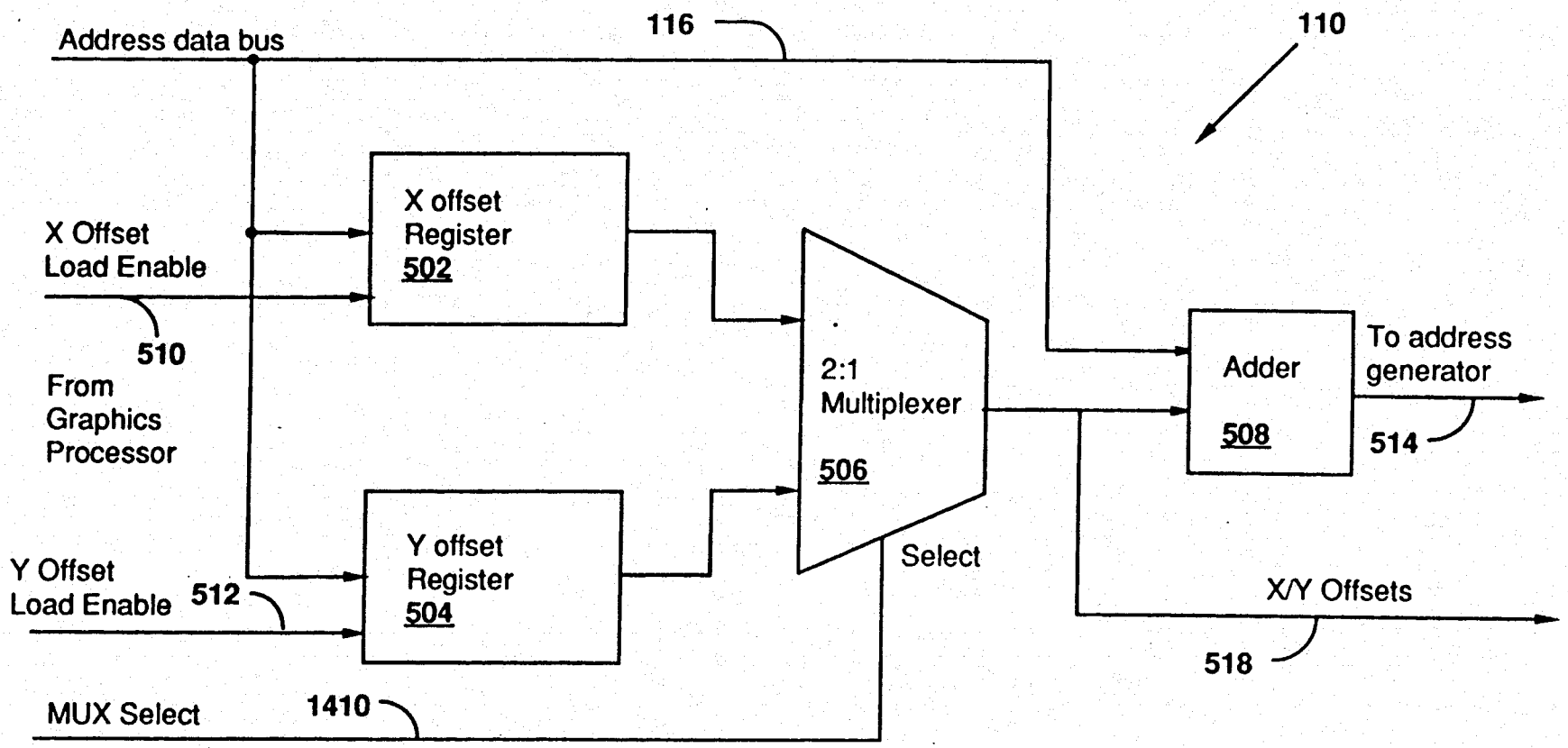
FIG. 5 is a block diagram of an embodiment of the off screen memory XY offset logic (block 110 of FIG. 1) of the system and method of the present invention.

The X,Y offset logic 100 is better understood by reference to FIG. 5. It includes two registers 502, 504 (which are used to hold X and Y offset data), a 2:1 multiplexer 506, and an adder 508 which is used to add the offset values to the address data as it is loaded into the off screen memory address generator 106.

In an embodiment tested by the inventors, the X and Y offset registers 502,504 were 16 bit registers (with only 12 bits being used in the tested embodiment), the multiplexer 506 was a 12 bit wide 2:1 multiplexer, and the adder 508 was an 12 bit adder. When the graphics processor 100 is writing to both the screen refresh and off screen memories in parallel, it always loads and counts the address generators for both memories in synchronism.

However, it is usually necessary to offset the actual addresses used by the off screen memory relative to the screen refresh memory in a manner transparent to the application software. The graphics processor 100 can control this offset in hardware by loading the desired value into the two offset registers 502,504. Once this is done, whenever the graphics processor 100 loads an X or Y address into both address generators, the multiplexer 506 selects the appropriate X or Y offset (depending on which counter is being loaded) and the adder 508 adds this offset to the address before being loaded into the off screen memory address generator 108 via the XY offset logic output line 514. Note that if it were possible for the processor to load both X and Y components of the address simultaneously, two adders would be necessary but the multiplexer would not. If linear addresses were used a single, wider width adder would be used to add an offset address.

It is preferable that negative offsets can be loaded into the offset registers 502, 504 and added to the addresses. This allows windows towards the right of screen to be simultaneously stored by off screen memory close to the left hand side of the off screen memory space.

As an alternative configuration, it would be possible to use a single address generator and an offset adder, (after the address generator), for the off screen memory. One disadvantage of this method is that an additional time cost is incurred on every memory access, not just on the address load. Address loads typically occur much less frequently than memory accesses involving a counter increment. Also, two independent address generators can be useful for other algorithms.

The operation of the MUX enable signal will now be explained by reference to FIGS. 5, 11, 13, 14A and 14B.

Figure 14A:
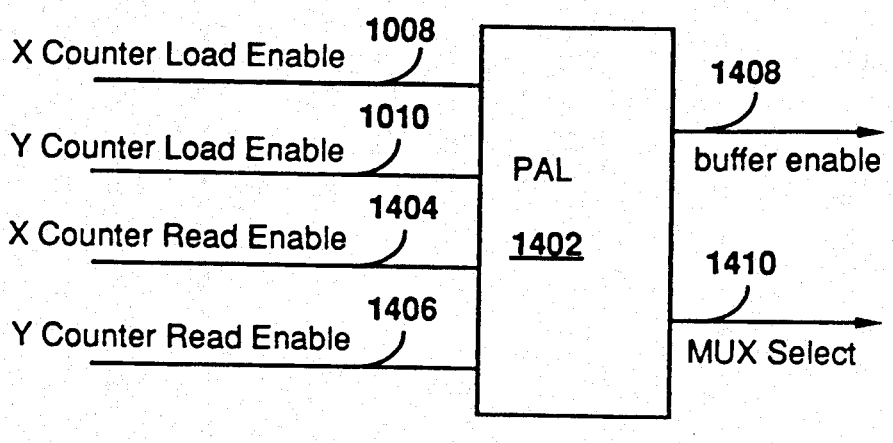
FIG. 14A is a block diagram of the control PAL 1402 for the MUX select and buffer enable signals 1410, 1408 of the present invention including the internal Boolean equations.
Figure 14B:
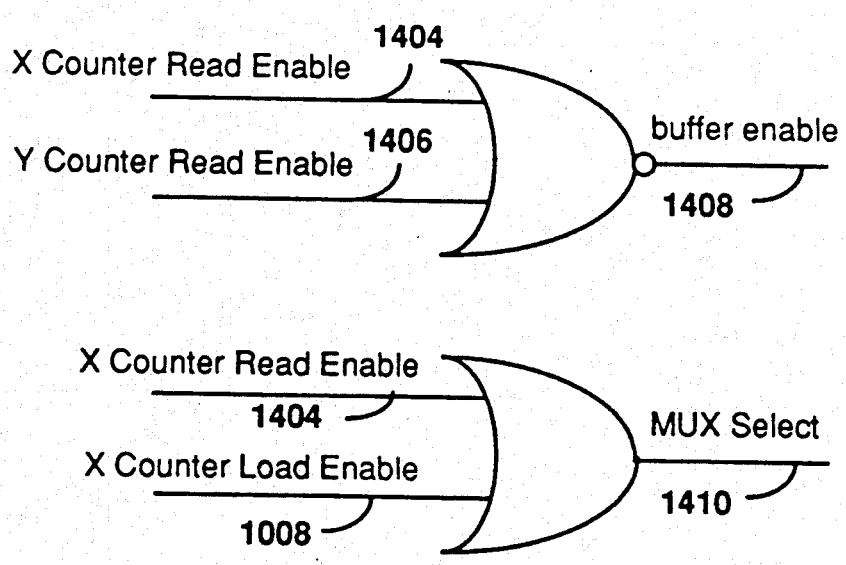
FIG. 14B is a block diagram representation of the logical operation of the control PAL 1402 of FIG. 14A.

The MUX enable line 1410 is used to control the offset MUX 506 and the readback MUX 1106. In the offset MUX 506, the MUX select signal carried on this line 1410, will cause the MUX 506 to select as its output either its X offset register input (the X offset value), or its Y offset register input (the Y offset value). The MUX select signal is preferably generated by a PAL 1402 on the graphics processor 100 using a logical "OR" of the signals carried on the X counter read enable line and X counter load enable lines 1404, 1008, (both of which are preferably generated by the graphics processor 100). A logical representation of the operations within the PAL 1402 is shown in FIG. 14B.

The X and Y counter load enable lines 1008, 1010 carry X and Y load enable signals generated by the graphics processor 100. These signals are used to load the X and Y counters within the systems address generators 106, 108. The X and Y counter read enable lines 1404, 1406 carry X and Y counter read enable signals generated by the graphics processor 100. These signals are used to enable the graphics processor 100 to read back addresses from the off screen memory address generator 108 (this process will be explained later).

In the case of the MUX select signal (on the MUX select line 1410), whenever an X counter Read Enable or X Counter Read Control signal are asserted, the offset MUX 506 (FIG. 5) will select its X offset input and the readback MUX 1302 (FIG. 13) will select its column address input 1106. When neither of the X Counter Read Enable and X Counter Control Signals are asserted, the MUX's 506, 1302 will select their Y offset and Row Address inputs respectively. It should be understood that the MUX's could just as easily be controlled by an "OR" of the Y Counter Read Enable and Y Counter Control signals so as to select the Y offset and Row address inputs on a logical "OR" of these two signals.

For some algorithms, it can be required to read addresses from the address generators back into the graphics processor. For example, the address generators can be used to generate the points on an endpoint list in order to scan convert a polygon. In these cases it is preferable to read back the offscreen address generator 108 because it has a larger address space than the refresh memory address generator 106. This makes it possible to generate objects larger than the address range of the refresh memory address generators. However, this raises the problem that the offscreen addresses are offset by the current offset value in the XY offset logic. This could make it impossible to use the read back values for reloading into either the refresh or offscreen address generator, in order to generate objects in either memory. To solve this problem, a hardware substracter 1304 (FIG. 13) is included in the readback path from the offscreen memory address generator 108 which automatically subtracts the current offset values in the X and Y offset registers 502, 504 from the X and Y addresses output from the off screen memory address generator 108.

Figure 13:
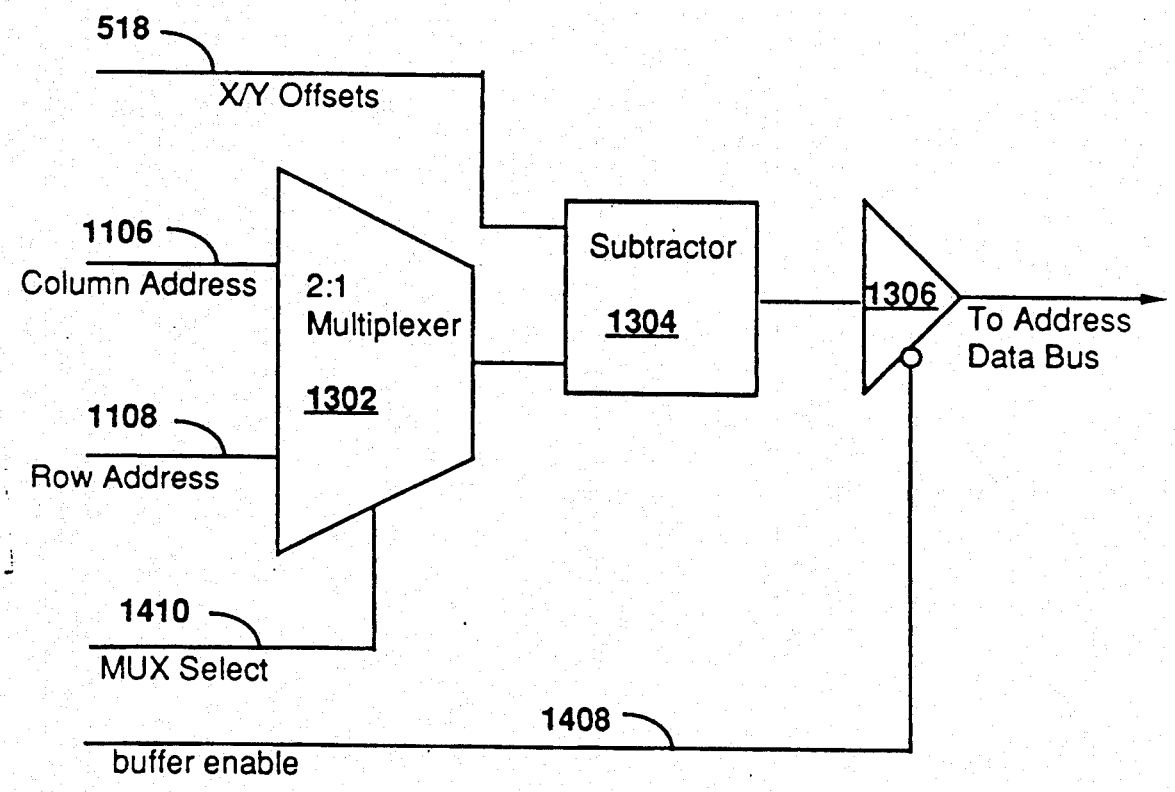
FIG. 13 is a block diagram of a preferred embodiment of the off screen memory address readback logic of the present invention.

The readback logic may be better understood by reference to FIG. 13. The readback logic preferably includes a subtracter 1304, a 2:1 multiplexer 1302 (the readback multiplexer), and a tri-state buffer 1306. A buffer enable signal (on the buffer enable line 1408) is generated by the graphics processor 100 by a PAL 1402 (FIG. 14).

When it is desired to readback absolute (i.e. unoffset) off screen memory address the MUX select line 1410 is toggled so as to cause the readback MUX 1302 to select either its column address or row address inputs 1106, 1108. These addresses are alternately supplied to the inputs of the subtracter 1304. Similarly, under control of the MUX select signal, the X and Y offsets are provided to the second input of the subtracter 1304. Because the readback multiplexer 1302 and the offset multiplexer 506 are controlled by the same MUX select line, the X offset will be fed into the subtracter at the same time as the column addresses, and the Y offset will be fed into the subtracter at the same time as the Y offset addresses. The resulting output of the subtracter 1304 will be an unoffset offscreen memory column or row (i.e. X and Y) addresses.

The generation of the MUX enable signal (on the MUX Enable line 1410) has been previously explained. The generation and operation of the buffer enable signal (on the buffer enable line 1408) will now be explained by reference to FIGS. 13, 14A and 14B.

The buffer enable signal is used by the readback logic 1400 to put the readback information on the address data bus 116 for reading by the graphics processor 100. When the buffer enable signal is low, the output of the subtracter 1304 is allowed onto the address data bus 116 by the tri state buffer 1306. When the buffer enable signal is high, the tri state buffer 1306 is in its high impedance state. It should be understood that the buffer 1306, the subtracter 1304 and the multiplexer 1302 must all be wide enough (i.e.. have enough bits) to accommodate the entire width of the off screen memory addresses.

The buffer enable signal is generated by a PAL 1402 on the graphics processor 100 as a logical "NOR" of the X counter read enable and Y Counter Read Enable signals (on lines 1404, 1406). Whenever the graphics processor 100 desires to read back off screen memory addresses, it asserts a sequence of the X counter read enable or Y counter read enable signals so as to enable read back data to be placed on the address data bus. As has been stated, the address data bus 116 is bidirectional and the graphics processor 100 can read any data appearing on it. Aside from enabling the output buffer 1306, the sequence of X counter read enable and Y Counter Read Enable signals also enables the proper selection of the X and Y address and offset data. The buffer enable signal is consistently asserted during the entire read back cycle. The subtracter 1304 is preferably designed using a TI 74AS181 chip (available from Texas Instruments).

The simultaneous screen refresh memory/off-screen memory system and method of the present invention can be enabled in various configurations. The graphics processor 100 can enable either one of the memories for reading at any time. Which memory is selected at any time is invisible to the application software. Also, the graphics processor 100 can enable any combination of the memories for writing (either, neither or both), regardless of which memory is selected for reading. According to the enabled mode, when the graphics processor asserts the read and write control lines, the enabled memories are either read from or written to.

When it is desired to process images only in the screen refresh memory 102, the graphics processor 100 read and write enables the screen refresh memory 102 and write disables the off screen memory 104. In this mode, pixel data flows between the screen refresh memory 102, and the graphics processor 100 or any other device on the pixel data bus 116. Although the pixel data also appears at the data inputs of the off screen memory 104, no memory writes occur. New pixel data can be written into the screen refresh memory 102 and used to refresh the display monitor. The off-screen memory will still contain the old, unupdated data. Data may also be read from the screen refresh memory if desired.

The off-screen memory access mode of the present invention operates in a similar manner. The graphics processor 100 read and write enables the off-screen memory 104 and write disables the screen refresh memory 102. In this mode of operation, pixel data flows only to and from the off-screen memory 104. The display monitor continues to be refreshed with the old, non-updated data from the screen refresh memory. Off screen memory reads can also be performed if desired.

It should be noted that while it is possible to write to both the screen refresh and off screen memories simultaneously, data may only be read from one memory at a time. Were data to be read from both memories simultaneously, interference would be caused on the pixel data bus 118. Therefore only one memory should be read enabled at any one time.

A simultaneous write may be performed by writing to both the screen refresh memory 102 and the off screen memory 104 in parallel. In this case, the screen refresh and off screen memories are both write enabled and data is simultaneously written into both.

Additionally, the off screen memory can be read enabled whilst both memories are write enabled if desired. Advantageously, this configuration can be used while processing partially visible windows. This aspect of the present invention allows processes such as fast fourier transformations, histograms, raster operations and other operations requiring pixel data reads to be performed on the complete image data (which has been stored in the off screen memory). The outputs of these processes can be displayed on the screen using the screen refresh memory. The off screen memory can be simultaneously updated with the new image data.

Alternatively, the off screen memory may be write disabled after the initial simultaneous write. In other words, the new image data would not overwrite the original image data in the off screen memory.

Leaving the original image data intact within the off screen memory can be very useful in cases where an image is to be distorted and it is required to keep an undistorted copy. For example where an image is to be warped in various ways, the off screen memory provides an advantage over the conventional art. This is so because it is typically much easier to form a newly warped image from an original than it is to remanipulate the data for an already warped image.

To perform a block copy, the graphics processor 100 write enables the screen refresh memory 102 and read enables the off-screen memory 104. As the graphics processor 100 generates address data on the address data bus 116, pixel data is automatically read from the off-screen memory 104, and written into the screen refresh memory 102. This may be readily understood when one considers that the two memories share a common pixel data bus and that the screen refresh memory 102 is write enabled. Block copies may also be performed from the screen refresh memory 102 to the off screen memory 104 by read and write enabling the memories in the opposite direction.

The block transfer operation of the system and method of the present invention may be accomplished by the use of a microcode executed by the graphics processor 100.

In an embodiment tested by the inventors, transfer rates of 120 Million Bytes/second between the memories were achieved. The microcode can transfer data in either direction, and can select any size and position of rectangular area for the source and destination. Where two dimensional patch areas are used, the transfer must occur on patch boundaries. It is important to note that by using this system the graphics processor 100 does not have to read the image data in order to perform a block copy. It merely needs to properly enable the memories, initialize the XY offset logic (if desired), and generate address data.

From FIG. 1 it may be observed that the address data bus 116 of the present invention is connected to the off-screen memory XY offset logic 110. Prior to the occurrence of an off-screen memory access (read or write), the graphics processor 100 may initialize the XY offset logic 110 with a predetermined offset value. As address information from the graphics processor 100 passes through the XY address logic 110 it is offset by the predetermined value.

The offset value accomplishes several functions. On pixel data write operations, image information written to the off screen memory 104 may be automatically translated to an area of memory, other than where it will appear in the screen refresh memory. This is accomplished by initializing the XY offset logic with an offset value other than zero. The same principle applies to off-screen memory read operations. Where the X and Y offset values are known, or have already been loaded into the XY offset logic, image data may be directly copied from the off-screen memory 104 to the screen refresh memory 102, and will be automatically translated so as to appear at a desired display location on the video screen.

Figure 2:
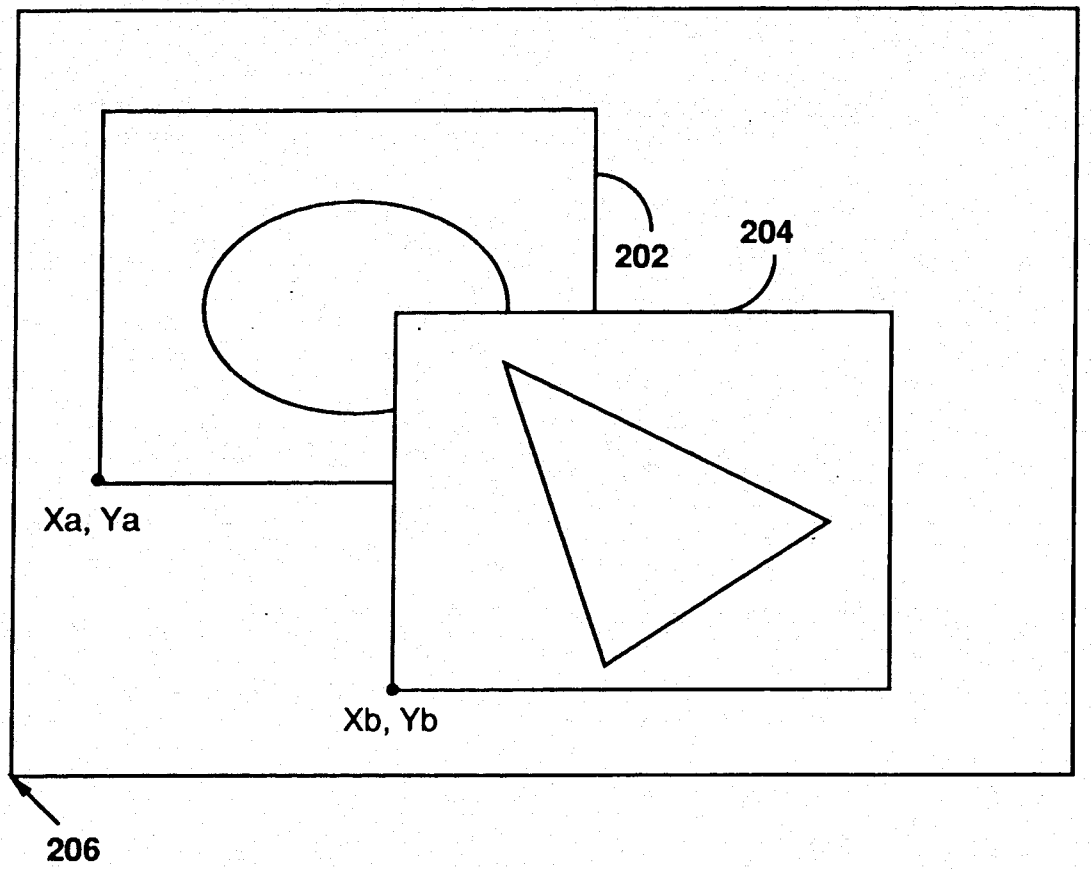
FIG. 2 is a graphical representation of a map of a screen refresh memory showing a foreground window 204 partially obscuring a background window 202.
Figure 3:
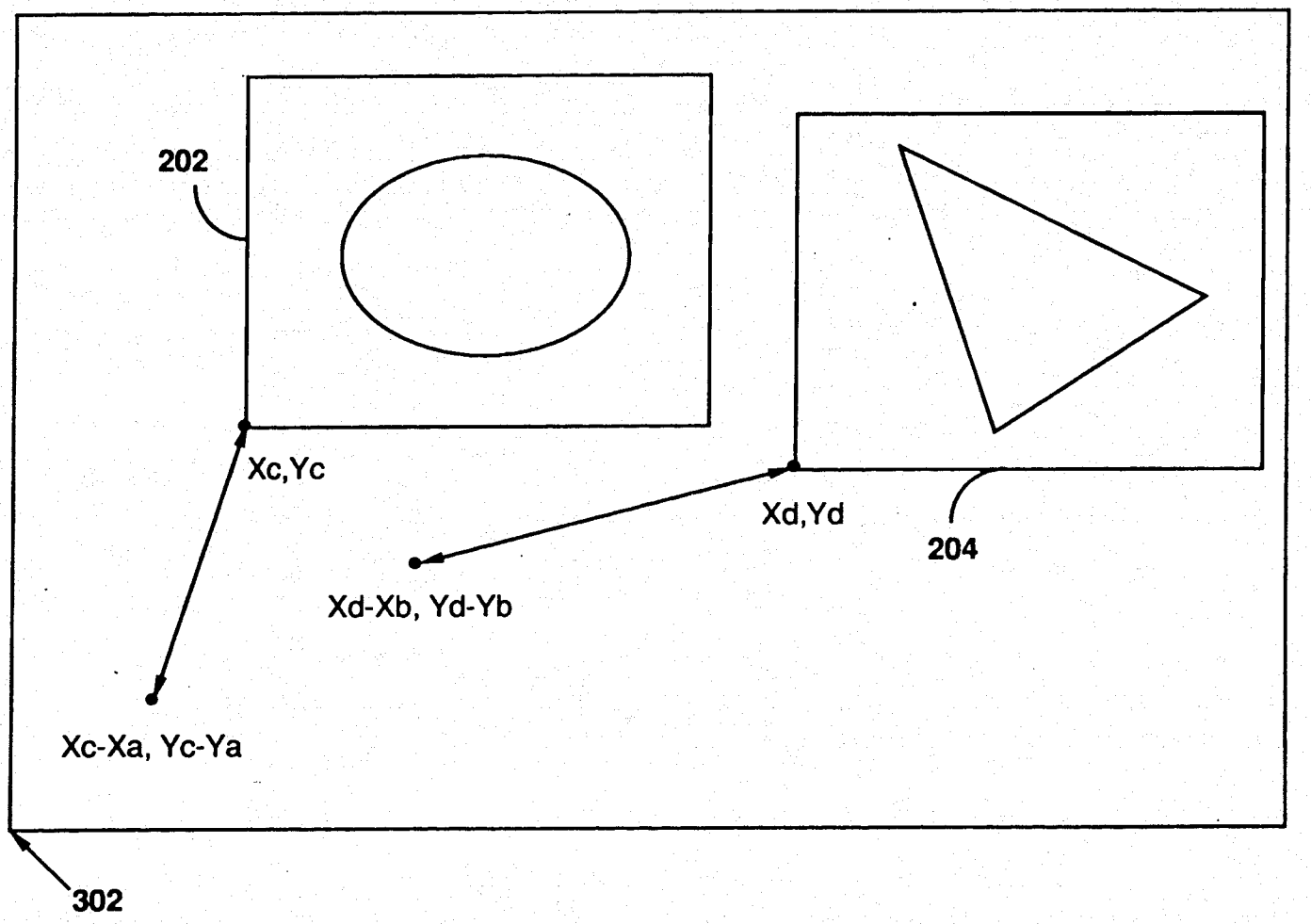
FIG. 3 is a graphical representation of how the complete and non-obscured version of the foreground and background windows of FIG. 2 can be stored in the off screen memory and method of the present invention.

The advantages of this offset ability of the present invention may be understood in reference to FIG. 2 and FIG. 3. These figures will be used to demonstrate an example where overlapping windows are to be displayed. The image data for a first window 202 may initially be written to both the screen refresh memory 102 and the off-screen memory 104 using the system's simultaneous write mode.

The image data for the first window 202 may be written into the screen refresh memory 102 so as to be mapped in with its lower left hand corner at an offset of Xa,Ya from the refresh memory's physical origin 206 (i.e. memory address 0,0). The image data for the first window would also appear at the pixel data inputs of the off screen memory 104. By initializing the XY offset logic 110 with an offset value {Xc-Xa, Yc-Ya}, (shown in FIG. 3), prior to the beginning of the write cycle, the image data written into the the off-screen memory may be mapped in at an offset {Xc, Yc} from its physical origin 302 which is different from the screen refresh memory offset {Xa,Ya}.

The second window would then be written to both the screen refresh memory 102 and the off-screen memory 104, using the simultaneous access mode. When the data for the second window 204 is written into the screen refresh memory 102 it will have a given offset {Xb,Yb} from the physical origin 204 and will overwrite the data for the first window 202 in locations where the two overlap. Advantageously, by initializing the the XY offset logic with an offset value {Xd-Xb, Yd-Yb}, the second window 204 can be simultaneously written into the off-screen memory at a new offset {Xd, Yd} which will cause the data for the second window 306 not to overwrite the data for the first window 202.

At the end of the write cycle the refresh memory will contain the complete data for the second window 204 and data for only the non-obscured portion of the first window 202. The displayed image will come from the screen-refresh memory and will show windows 202 and 204 as overlapping. The image data stored in the off-screen memory will be the complete image data for both windows 202, 204. That is to say, the off-screen memory 104 will not be missing the data from the obscured area of the first window 202.

The process of the present invention operates equally well in reverse. Assume that the second window is removed from the display. In order to accomplish this, the image data for the second window image must be overwritten with new data to the screen refresh memory 102. This leaves a gap in the first window data where it was previously obscured by the second window.

Figure 4:
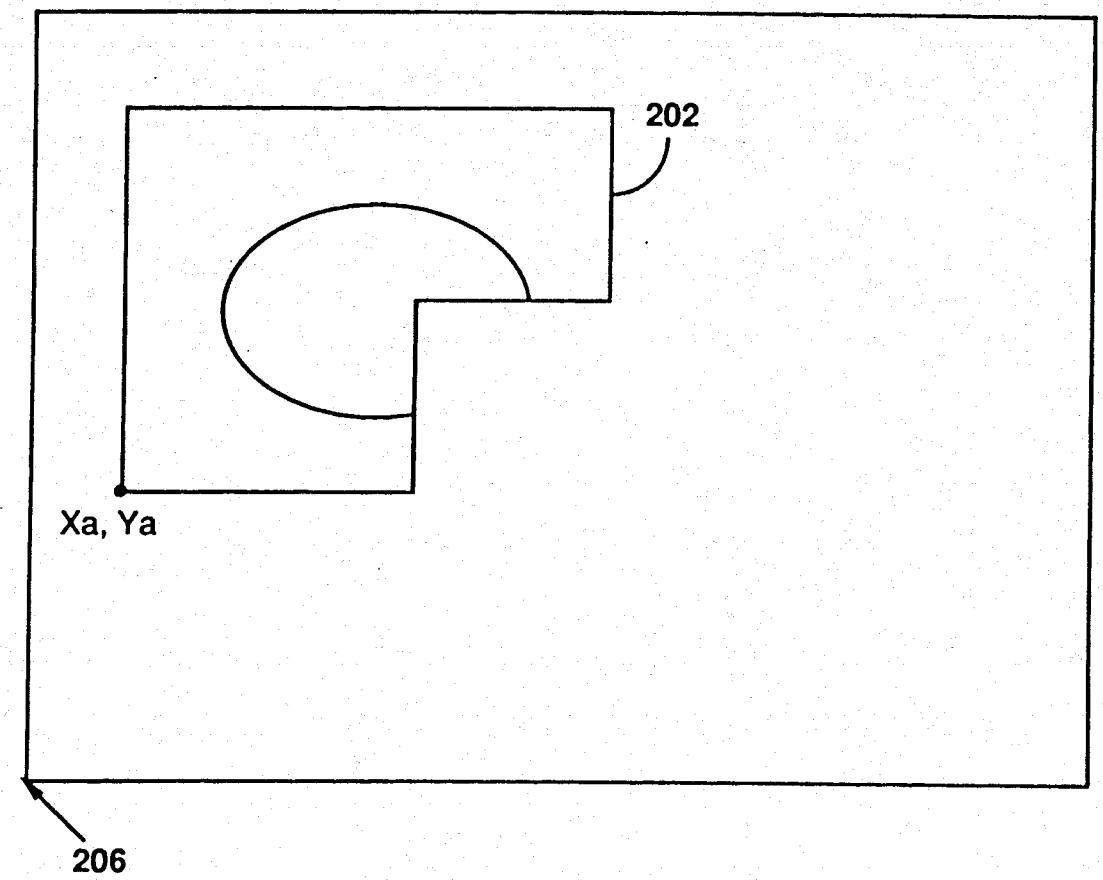
FIG. 4 is a graphical representation of how a background window 202 might appear in a screen refresh memory after the obscuring foreground window (not shown) is moved or deleted.

This is illustrated by FIG. 4. In order to fill in this gap, conventional systems usually rerun the display list for the remaining window thereby regenerating the missing corner. By using the XY offset logic and a block copy operation the image data for the first window may be used to repair the gap. All that needs to be done is to initialize the XY offset logic with the off screen memory offset value {Xc-Xa, Yc-Ya}, and block copy the missing corner of the window from the off-screen memory 104 to the appropriate address space in the screen refresh memory 102.

The presently preferred embodiment of the XY offset logic is designed using AMD 29520 integrated circuits to perform both the registering and multiplexing functions. Optionally, the 29520 chips can be used to store two alternative XY offsets, and perform the further multiplexing functions. The AMD 29520 is made by Advanced Micro Devices of Sunnyvale, Calif.

In cases where the off screen memory 104 of the present invention is of a size larger than the screen refresh memory, provision should be made for clipping images to the borders of the display screen. The need for a screen detector type clipping circuit can be illustrated by an example where the image stored in the off screen memory is larger than the screen refresh memory. If such an image were to be copied to the screen refresh memory, the screen refresh memory's address counters would wrap around (i.e. go beyond the upper address limits and back through zero), causing the image displayed on the screen to also appear wrapped around.

A conventional screen detector type clipper can be used to prevent wraparound on the screen in these circumstances where objects are drawn which extend over the boundaries of the screen. An example of such clippers can be seen in U.S. Pat. No. 4,642,621, to Nemoto et al.

The preferred screen detector/clipper is available on the Du Pont Pixel Systems bFx framestore extension, available from Du Pont Pixel Systems Limited, 5 Penrhyn Road, Kingston-upon-Thames, Surrey KT1 2BT, England.

The preferred screen detector-clipper is a hardware clipper, using four hardware comparators to compare the offset offscreen memory addresses against a preset rectangular region. In order to prevent wraparound, the rectangular region can be permanently set to the physical address dimensions of the refresh memory. The screen detector-clipper uses the offset addresses generated by the offscreen memory address generator 108, (which are larger than the refresh memory address generator 106), to prevent wraparound within the entire address space of the offscreen memory.

In the tested embodiment the offscreen memory address range was −5K to +15K in X and −8K to +8K in Y (measured relative to the screen refresh memory address range). It is preferable that the address range does include a negative portion so that wraparound is prevented on all screen edges.

It should be noted that the actual offscreen addresses are offset by the current XY offset values. Hence as offset values are loaded to the offset registers it is also required that the software also adjust the screen detector clipper values by the same amounts as the change in origin value. This is necessary to keep the clipped region fixed to the physical refresh memory address space, as physically the clipper uses the offscreen addresses which are offset by the current offset value.

When the screen detector-clipper detects that current refresh memory address is outside the physical refresh memory area, it sets an output line to a logical zero. Otherwise it outputs logical one on this line. This output line is used to write disable the screen refresh memory 102 by further qualifying the screen refresh memory write enable signal. When a logical zero is output from the screen detector/clipper the screen refresh memory write enable is held in its disabled state. When a logical one is output from the screen detector/clipper the screen refresh memory can be write enabled (assuming all other qualifying signals, if any, are properly set).

c. Window Manipulation and Repair

The present system provides the designer and programmer with the ability to perform several significant functions at extraordinarily high speeds. Among those are window repair and manipulation.

The steps involved in window repair have been generally explained within. First, an background image window is simultaneously written to the screen refresh memory and the off screen memory. During the write, the addresses provided to the offscreen memory are offset from the screen refresh memory addresses by X and/or Y values that will cause the first image to be written mapped into different memory locations than for the screen refresh memory.

Next, a foreground (overlapping) window is simultaneously written into the screen refresh and off screen memories. Again the addresses provided to the off screen memory are offset from those provided to the screen refresh memory. In this case it is important that the offset used for the offscreen memory will offset the two windows from each other and from any other windows in the off screen memory so that there are no overlapping areas.

Those skilled in the art will recognize that all of the windows need not be written into the off screen memory with offset addresses. It is only necessary that the off screen addresses be offset from each other so that no windows overlap.

In order to repair the background (partially obscured) window once the foreground (obscuring) window is moved or deleted, the obscured portion is block copied back to the screen refresh memory at the proper address. By loading the offset register with the initial offset value, the offset is effectively subtracted (or added in the case of a negative offset) during the block copy.

Similarly, the off screen memory can be used to change the relative positions of the background and foreground windows (i.e. bring the background to the foreground and visa-versa). This is accomplished by performing the initial memory writes just as above (to initially store the image data for both complete windows in the off screen memory). When it is desired to change which window is on the top, the overlapping region for the window to be moved to the top is block copied from the off screen memory to the overlapping (and overwritten) area of the screen refresh memory. To reverse from top to bottom again, the corner is recopied to the screen refresh memory from the new background windows area of off screen memory.

Some other examples of window manipulation with the off screen memory include:

- producing animation by repeatedly copying different parts of the off screen memory into a window.
- changing sizes and positions of the windows by clearing the screen refresh memory and copying in completely, all the windows from the off screen memory, in reverse priority order.
- changing sizes and positions of the windows by clearing and copying selected parts of the images, necessary to repair the screen after windows have been moved.

d. Arbitrary Shape Clipper

In many imaging and graphics systems it is necessary or desirable to perform clipping. Clipping generally involves inhibiting the display of part of an image so as to conform to a desired contour. Clipping may be accomplished in software, (which is generally slow and complex). It may also be accomplished in hardware.

The present system and method preferably employs an arbitrary shape clipper (ASC) which operates by using a RAM stored map of the enabled and disabled areas of the screen. During write accesses, the map is accessed automatically using the address that is sent to the screen refresh memory. The content of the map determines whether the write is allowed to take effect. A significant advantage of the present arbitrary shape clipper is that because any shape can be stored in the RAM map, an image can be clipped to any given contour.

One embodiment of the arbitrary shape clipper includes eight RAMs, each of which holds a complete map of the display screen with one active window. Areas where the window is visible are stored as logical '1's, and the rest of the screen is stored as logical '0's. By accessing these RAMs, up to eight windows can be automatically clipped.

Each process need only access the RAM corresponding to its window. The clipping operation is performed automatically by the arbitrary shape clipper hardware.

The operation of the arbitrary shape clipper may be better understood by reference to FIG. 1. Whenever an image process becomes active, the computer system's graphics processor 100 selects the RAM within the arbitrary shape clipper which holds the clip map for its window. As the screen refresh memory's address generator 106 begins to address the screen refresh memory 102, the address information is also fed into the arbitrary shape clipper 112.

Within the arbitrary shape clipper, the screen address information is used to access the selected RAM. This RAM, outputs one bit of information for every location of the screen refresh memory addressed. This information is logically "ANDed" with the screen refresh memory's write enable signal. For addresses where the arbitrary shape clipper's RAM contains a logical "1", the screen refresh memory 102 will be write enabled. For addresses where the RAM map contains a "0", the screen refresh memory will not be write enabled.

The use of a 160 bit wide pixel data bus 118 permits the arbitrary shape clipper's map RAMs to be smaller than the screen refresh memory. Where patches of 5 by 4 pixels are accessed at each cycle, the display screen will consist of 64K, independently addressable locations thereby reducing the required size of each arbitrary shape clipper RAM to 64K by 1 bit.

The inventors have discovered that the use of such patches on a high resolution monitor does not perceptibly affect image clipping because only the window boundaries are placed on the nearest patch boundary. This resolution is fine enough to allow smooth window sizing and positioning. Where finer granularity is desired, each pixel on the screen may be addressed independently and larger map RAMs may be used.

The RAMs within the arbitrary shape clipper are preferably of the static type for speed purposes. The arbitrary shape clipper 112, takes advantage of the delayed write in the refresh memory access cycle to insure that the refresh memory is disabled or enabled by the time the image data is ready to be written. This principle may be better understood by reference to FIG. 6 and FIG. 7.

Figure 7:
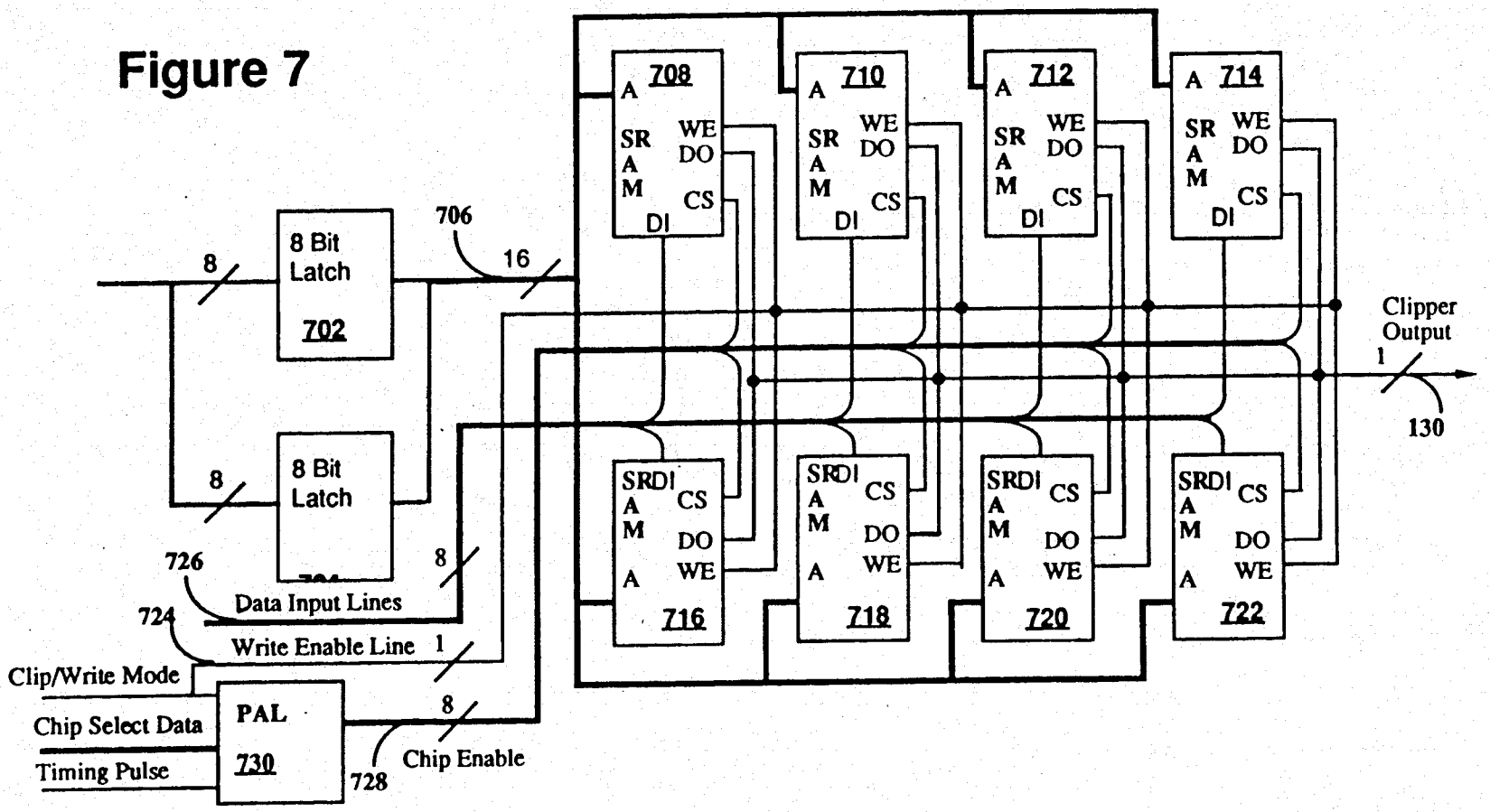
FIG. 7 is a block diagram of the arbitrary shape clipper logic (block 112 of FIG. 1) and shows the graphics processor PAL 730.

FIG. 7 is a block diagram of the arbitrary shape clipper logic. Two eight bit latches 702, 704 are used to latch the eight bit row and column addresses so as to form a single sixteen bit wide internal address bus 706. One of the eight bit latches should be set up to latch concurrent with the row address strobe (RAS) 602, while the other should latch concurrent with the column address strobe (CAS) 604. This may be accomplished by using the RAS and CAS directly or through the use of additional timing logic (such as) that is well known in the art.

The Static RAMs 708, 710, 712, 714, 716, 718, 720, 722 are preferably at least 64K×1, of a type such as IDT7187 available from IDT of California, U.S.A. Each static RAM includes a data input, a data output, a single bit chip select input, a single bit write enable input and address inputs. The data output pins of all the RAMs are tied together into the clip output line 130.

In the preferred embodiment, the operation of the arbitrary shape clipper 112 is controlled by: 1 mode bit (i.e. the clip/write mode bit on line 724) that sets the ASC into either the 'clip' or 'write' mode, 8 select bits 728 (one for each RAM)—that selects one RAM for clipping or any combination of RAMs for writing, and 8 data bits 726 which supply data to be written to each of the RAMs when in write mode. The clip/write mode bit (line 724) is tied to the write enable pin of all the RAMs. All seventeen of these control bits preferably originate from the graphics processor 100 and are carried on the arbitrary shape clipper control lines 128. In an embodiment tested by the inventors, the chip select lines 728 were generated by a programmable logic array (PAL) 730 in the graphics processor 100. The mode bit was used as an input by the PAL.

The PAL 730 uses the clip/write mode bit (on line 724) as a gating signal to ensure that only one chip enable can be asserted when the clipper is in clip mode, so as to prevent contention between RAMs. When in clip mode the RAM holding the window clip pattern to be used is continually chip enabled, but not write enabled. As all the other RAMs are not chip enabled only the selected RAM will drive the clipper output line 130. When in write mode, any combination of RAMs can be written to.

To achieve this, all the RAMs are continually write enabled by the clip/write mode line 724, thus allowing the RAMs to be written to by asserting just the chip enables. The processor uses 8 control lines as a mask pattern to cause the PAL to assert any combination of eight chip enables 728. In addition, the PAL will also time the chip enables 616 (preferably using a timing pulse 614 from the graphics processor) in write mode so as to only enable (and therefore write to) the RAMs when the address latches have latched valid data (see FIG. 6). The programming of programmable logic arrays is well known by those skilled in the art.

It is alternately possible to pass all seventeen control bits straight through to the ASC and eliminate the PAL. However, in this case, care must be taken to program the graphics processor 100 so that no chip enable signals are asserted at the same time as the write enable signal, and that the timing of the chip enable in write mode is ensured.

Figure 6:
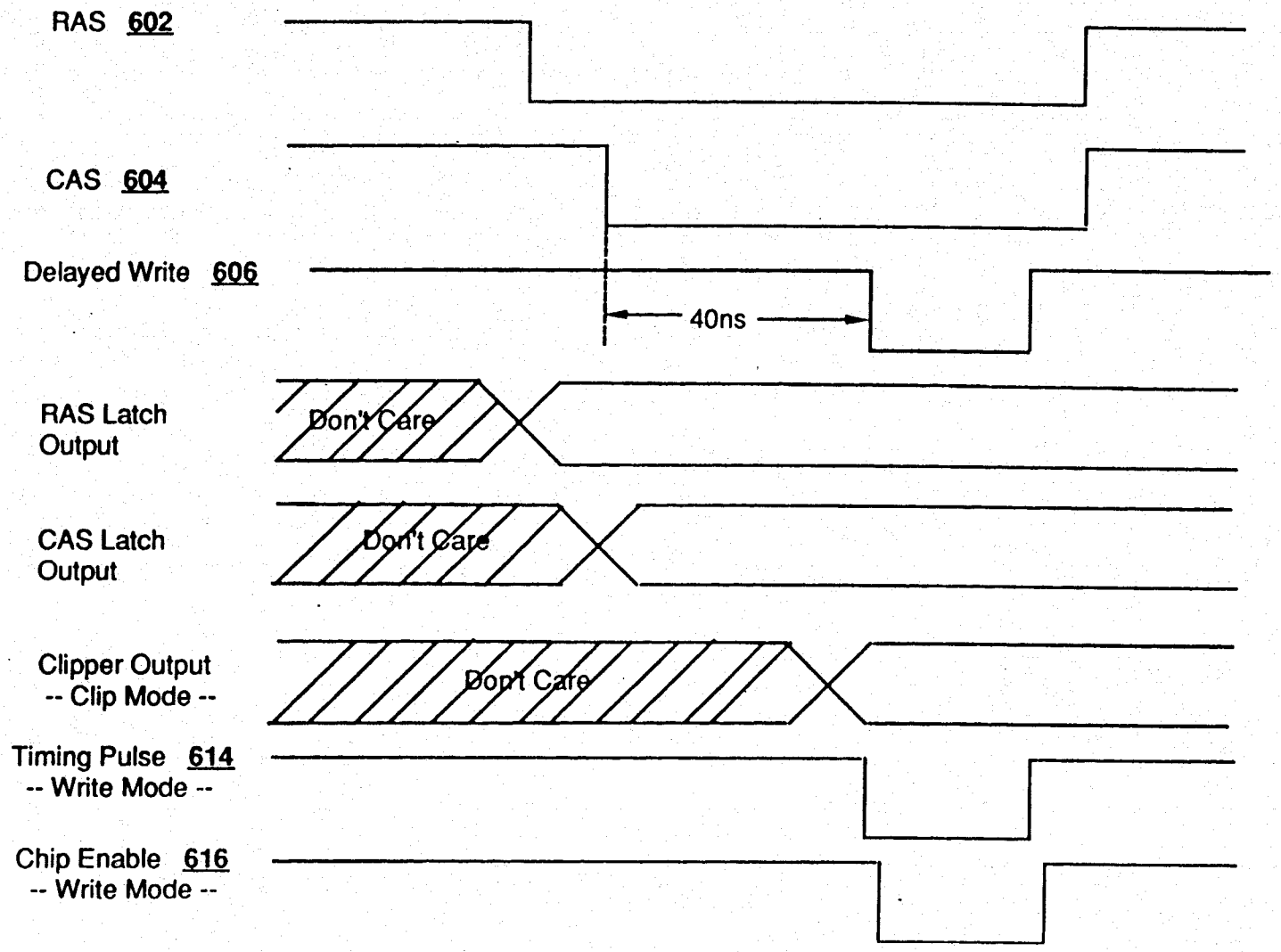
FIG. 6 is a timing diagram of the frame store delayed write, and the arbitrary shape clipper operation of the present invention.

The actual timing of the clipping operation and the reason for using static (as opposed to dynamic) RAMs in the ASC may be better understood by reference to FIG. 6. FIG. 6 is a timing diagram of a delayed write to the screen refresh memory 102. In order to perform a clip operation, the two eight bit latches 702, 704 must initially be loaded with the row and column addresses from address bus 127 (FIG. 1).

As may be seen from FIG. 6, the column address usually appears and is loaded after the row address and about 40 nanoseconds before the write enable pulse (on line 134) for the delayed write 606. The chip selects 732 (and hence a chip enable 728) and other control lines should be set up in advance of the write cycle so that the ASC is ready to operate immediately and produce an output before the write pulse to the frame store memories, (i.e. the screen refresh and off screen memories), occurs.

From FIG. 6, is may be seen that the ASC has about 40 ns in which to make the write enable bit (on line 120) available and stable at the screen refresh memory 102. In order to accomplish this, data must be accessed and stable at the outputs of the selected ASC static RAM in about 40 ns minus the propagation delay of the 'AND' gate 114 (about 5 ns—see FIG. 1) and minus the propagation delay of the latch 704 (about 10 ns).

In order to reduce the required speed of the ASC RAMs as far as possible, the column address latch 704 is not a D type register, but is instead a transparent latch. The latching signal is not CAS itself but a related timing signal which enables the latch slightly before the column address becomes valid. Hence as soon as the column address from the address generator becomes valid, it is passed directly through the transparent latch, avoiding clocking delays which would be present through a D type register. The Row address latch 702 can be a D type latch or a transparent latch because the Row Address Strobe is not the critical timing element. In an embodiment tested by the inventors, latch 702 was a D type latch.

At the present time, inexpensive static RAMs are available that can meet these time constraints. The inventors envisage that inexpensive dynamic RAMs and other devices will eventually be available that will also meet these constraints. It is therefore contemplated that any RAM with sufficient timing characteristics can be substituted for the static RAMs. It should be understood that the circuit of FIG. 7 can be easily modified to accommodate larger RAMs so as to decrease the clip granularity, (which is a 5 by 4 patch in the current embodiment).

Alternatively, if it is required to use RAMs with a slower access, the frame store RAM access cycle time can be stretched out (i.e. made longer). This is, however, less desirable than using faster (e.g. high speed static) RAMs in that it tends to degrade the performance of the system.

Advantageously, the arbitrary shape clipper 112 can be programmed without any software overhead. When the screen refresh memory 102 is initialized, the RAMs within the arbitrary shape clipper 112 can be initialized as well, so that every memory location in every RAM contains a logical zero. The RAMs within the arbitrary shape clipper 112 may be write enabled prior to clearing the window area. For every location addressed within the screen refresh memory, (which will be for the windowed area), the graphics processor 100 sets up to write a logical one into the corresponding address of the selected arbitrary shape clipper RAM which is to hold to clip pattern for this window. In this manner, a map of the screen with the active window or windows for that process will be automatically formed.

When a new window is opened which overlaps the first window, the first window's map RAM can be modified automatically to conform to the new contour. This is performed by write enabling all of the clipper RAMs, setting the data bit for the window's RAM to a logical '1' and setting the data bits for the remaining clipper RAMs to a logical '0'. As the window addresses appear on the address bus 127, logical '1's will be written into the addressed areas of the window's clipper RAM, while logical '0's will be written into the addressed area of the remaining clipper RAMs. Any address areas where the new window overlaps old windows are thereby overwritten so as to prevent the obscured windows writing data into the new window area.

e. High Bandwidth I/O on a Pixel Data Bus

Advantageously, the pixel data bus, in its preferred 160 bit wide form can be used to attain a high bandwidth for I/O devices. By using the pixel data bus for I/O, the facilities of the off screen memory and the arbitrary shape clipper can be made available to process a real time video window on a high resolution, bit mapped display monitor. A patch crossbar converter may be used to convert the parallel input of standard I/O devices into patch format, (five by four by eight, for example). The thus converted I/O data may be used by the off screen memory and arbitrary shape clipper at high transfer rates.

Figure 8:
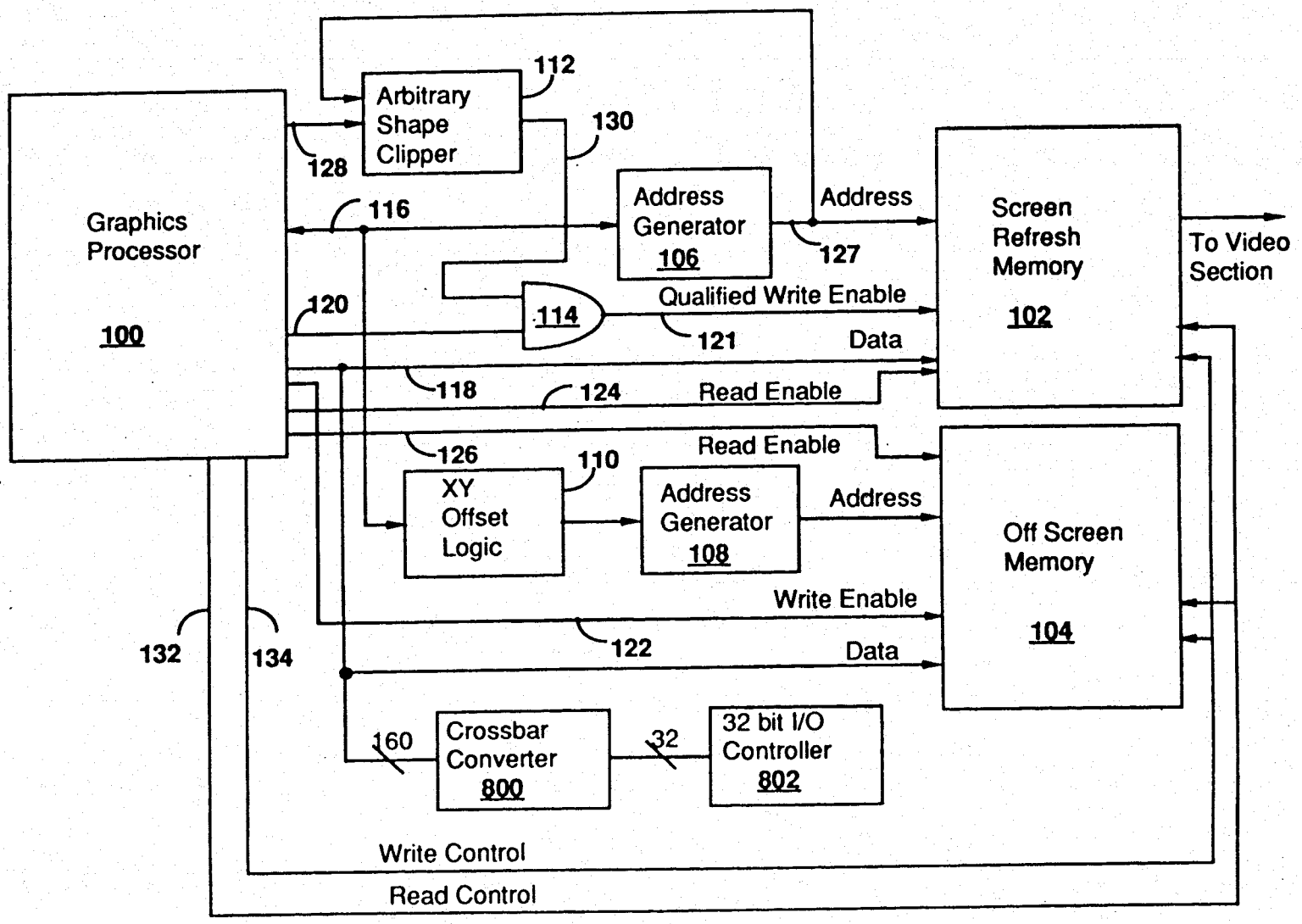
FIG. 8 is a block diagram similar to FIG. 1 and further includes the crossbar converter of the present invention.

The entry point for I/O data onto the pixel data bus may be best seen by reference to FIG. 8. The cross bar converter of the present invention shares the pixel data bus with the screen refresh memory and the off screen memory. In the preferred embodiment, the crossbar converter is used to convert 32 bits of parallel I/O data (in conventional linear raster scan format) into a raster scan succession of two dimensional patches (preferably of five by four pixels, each pixel being defined by eight bits of data).

The 32 bit I/O controller 802 and the crossbar convertor 800 should be under the control of the graphics processor 100, preferably by using a section of the graphics processor's microword. One embodiment of this feature would be to have one bit of the microword dedicated to enableing and disableing the state machine clock. A second bit of the microword could be used control the flow of data into and/or out of the I/O controller (e.g. by controlling handshaking lines on the data input side and/or turning off the data clock on the output side).

Alternatively, the crossbar converter may be kept under the control of the graphics processor and the 32 bit I/O controller may be under autonomous control. If this method is used, data flow control between the crossbar converter and the 32 bit I/O device may be accomplished using conventional handshaking techniques.

Due to the fact that the graphics processor 100 inevitably has a control of the data flow out of the cross bar converter, data may be caused to flow from the crossbar converter's pixel bus output to any permutation of the refresh memory, the off screen memory and the graphics processor. Window data from an I/O device may be clipped in the same manner as window data from the graphics processor or off screen memory. It should be understood that the crossbar converter can additionally perform the function of converting data from 160 bit patch format to 32 bit parallel I/O format.

The off screen memory provides an added advantage in the acquisition and processing of I/O data. By using the crossbar converter 800 or a frame grabbing device in conjunction with the off screen memory, many problems resulting from a disparity in the video image and graphics system frame rates can be eliminated.

For example, typical high resolution bit mapped monitors display at 60 Hz non-interlaced, while typical cameras at 25–30 Hz Interlaced. The present system may be used to resolve this problem by copying data from camera into the off-screen memory at the camera rate, and double buffering by block copying, only complete images from the off screen memory onto the screen (normally in sync with the display rate).

In this manner, a high quality, real time window may be generated. Advantageously, the real time window can also utilize the facilities of the arbitrary shape clipper 112. Additionally, the large size of the off screen memory may be used by storing a complete sequence of images from the I/O device for later display and/or processing.

Figure 9A:
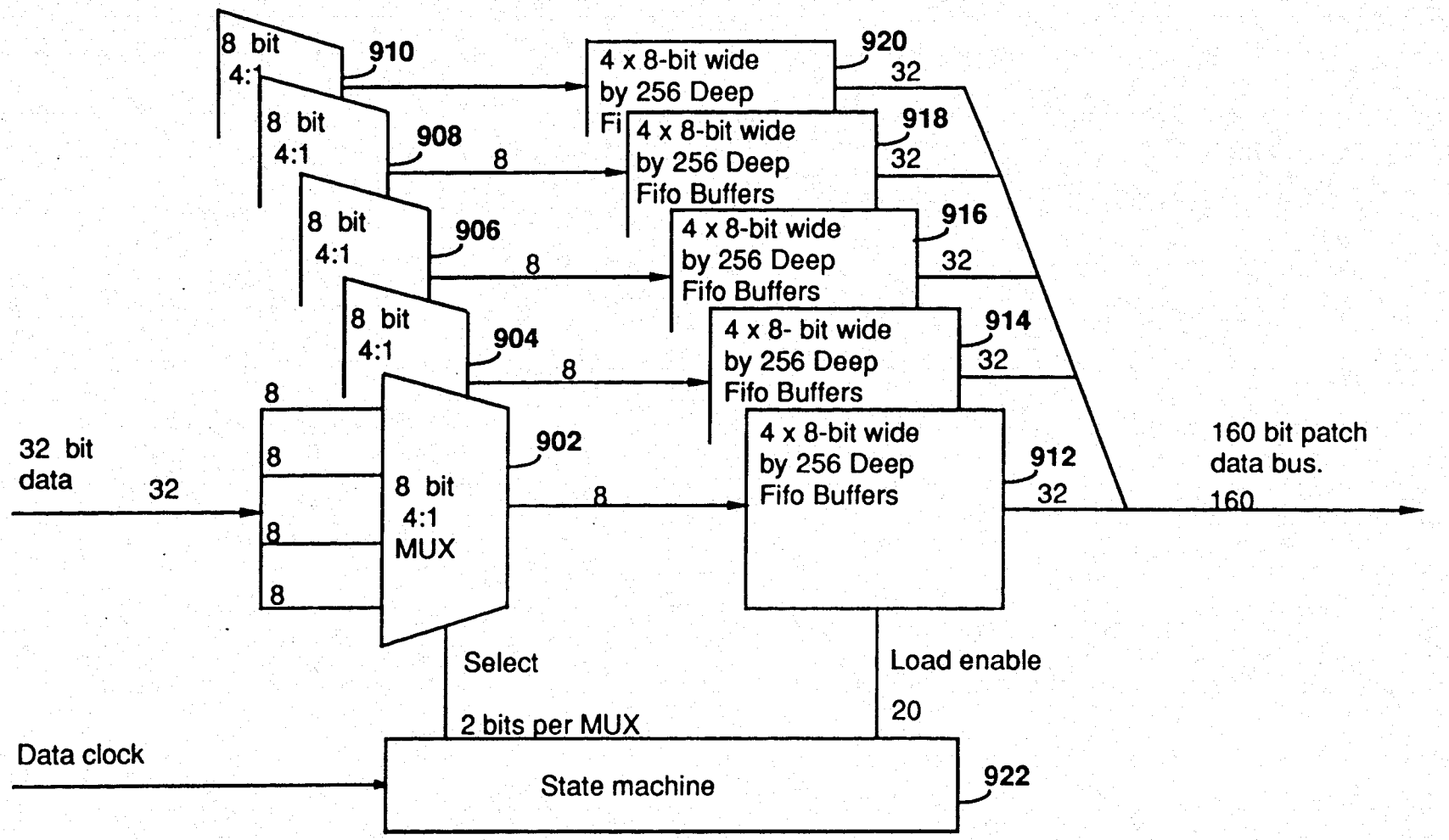
FIG. 9A is a more detailed block diagram of an embodiment of the crossbar converter 800 of FIG. 8.

The crossbar converter may be best seen in detail by reference to FIG. 9. To convert a 32 bit data stream into patch format or vice versa requires data reorganization. For input, (i.e. conversion from a 32 bit data stream into a patch), the crossbar converter utilizes a number of hardware fifo buffers. As 32 bit data values are received, a state machine 922, (preferably a RAM), controls which part of the 32 bit word is routed to which fifo and which fifos are loaded with data.

This arrangement makes it possible to treat the 32 bit data stream as a sequence of pixels arriving in a raster pattern where successive input pixels follow along a row. When the fifo buffers hold a complete row of patches, the graphics processor 100 can initiate a sequence of patch transfers to load the data into the screen refresh memory 102 and/or the off screen memory 104.

The preferred embodiment of the crossbar converter uses five, 8 way 4:1 multiplexers 902, 904, 906, 908, 910. Each multiplexer receives, at inputs, all four bytes of the 32 bit parallel I/O data word. Each byte is used as one of the four inputs to each multiplexer. The output of each of the 8 bit wide, 4:1 multiplexers is tied to four 8 bit, 512 deep fifo buffers 912, 914, 916, 918, 920, making 20 fifos in all. Electrically, this allows each of the five multiplexers to have it's output stored by any one of the four, eight bit fifo buffers associated with that multiplexer. At any given time only 5 of the 20 fifos are being used actively for data input. Those five fifos being used to store a line of input data.

Figure 9B:
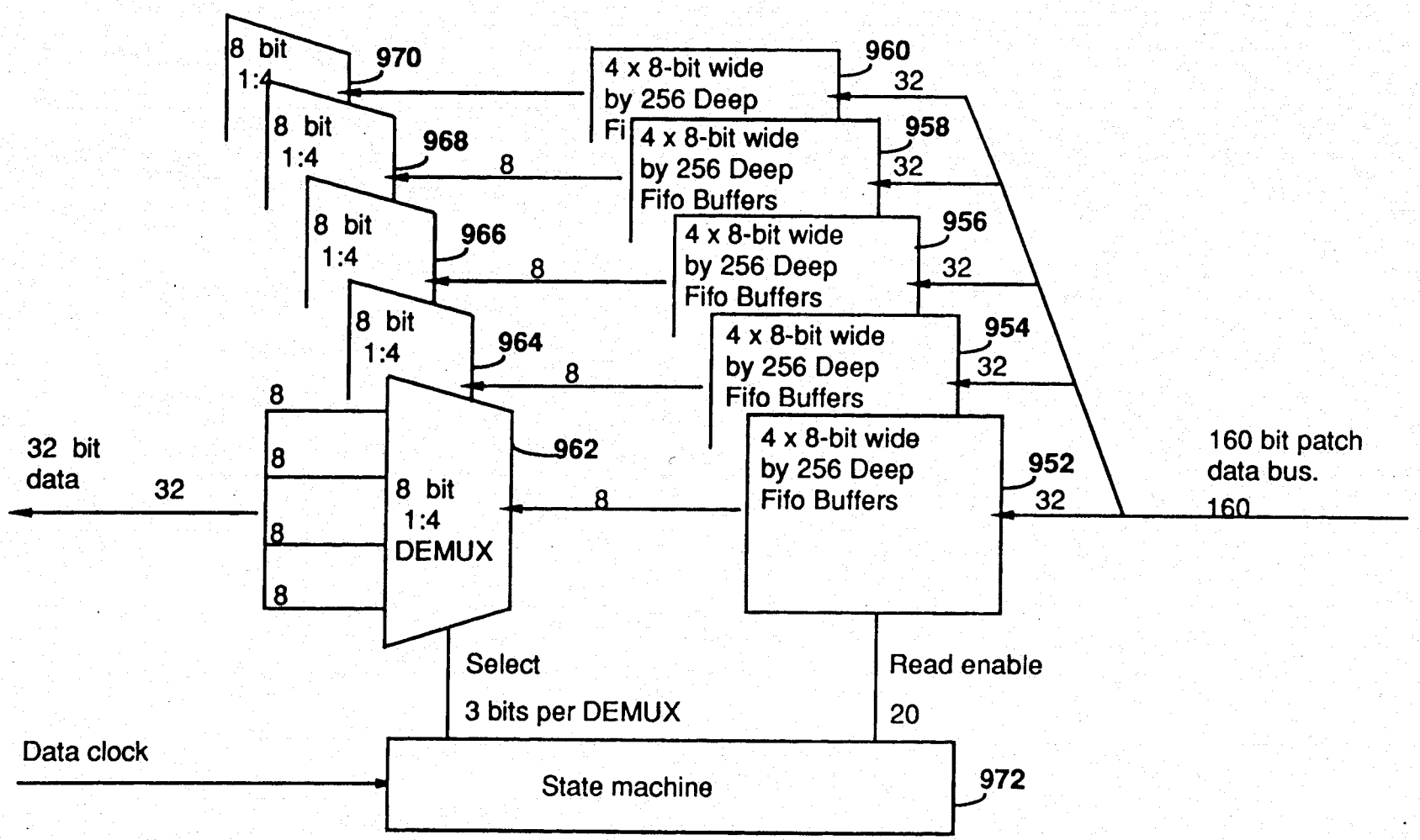
FIG. 9B is a block diagram showing a reverse crossbar converter of the embodiment shown in FIG. 9A.

As shown at FIG. 9B, the reverse method entails converting 160 bit (20 byte) parallel groups of pixel data into 32 bit (four byte) parallel groups of raster formatted pixel data. The 160 bit (20 byte) parallel groups of pixel data are organized into a 2 dimensional patches with four rows of five pixels, and each pixel is represented by one byte. The 32 bit (four byte) parallel groups of raster formatted pixel data consist of a predetermined number of bytes. The reverse method is comprised of the following steps.

First, a series of 160 bit patches are stored into a group of twenty, eight bit fifo buffers 952, 954, 956, 958, and 960, so that the first row of each patch is in a first subgroup of five fifo buffers, the second row of each patch is in a second subgroup of five fifo buffers, the third row of each patch is in a third subgroup of five fifo buffers and the fourth row of each patch is in a fourth subgroup of fifo buffers, and each patch is stored at a progressively deeper level into the fifos.

The pixel data is then accessed by DEMUX's 962, 964, 968, and 970 under control of State Machine 972 within preselected fours of the first subgroup of five buffers in first-in-first-out fashion. The pixel data representing a first horizontal scan line is first accessed in sequential groups of 32 bits.

The pixel data is accessed within preselected fours of the second subgroup of five buffers in first-in-first-out fashion, and the pixel data representing a second horizontal scan line is first accessed in sequential groups of 32 bits.

The pixel data within preselected fours of the third subgroup of five buffers is accessed in first-in-first-out fashion, and the pixel data representing a third horizontal scan line is first accessed in sequential groups of 32 bits.

The pixel data within preselected fours of the fourth subgroup of five buffers is accessed in first-in-first-out fashion, and the pixel data representing a fourth horizontal scan line is first accessed in sequential groups of 32 bits.

Figure 15:
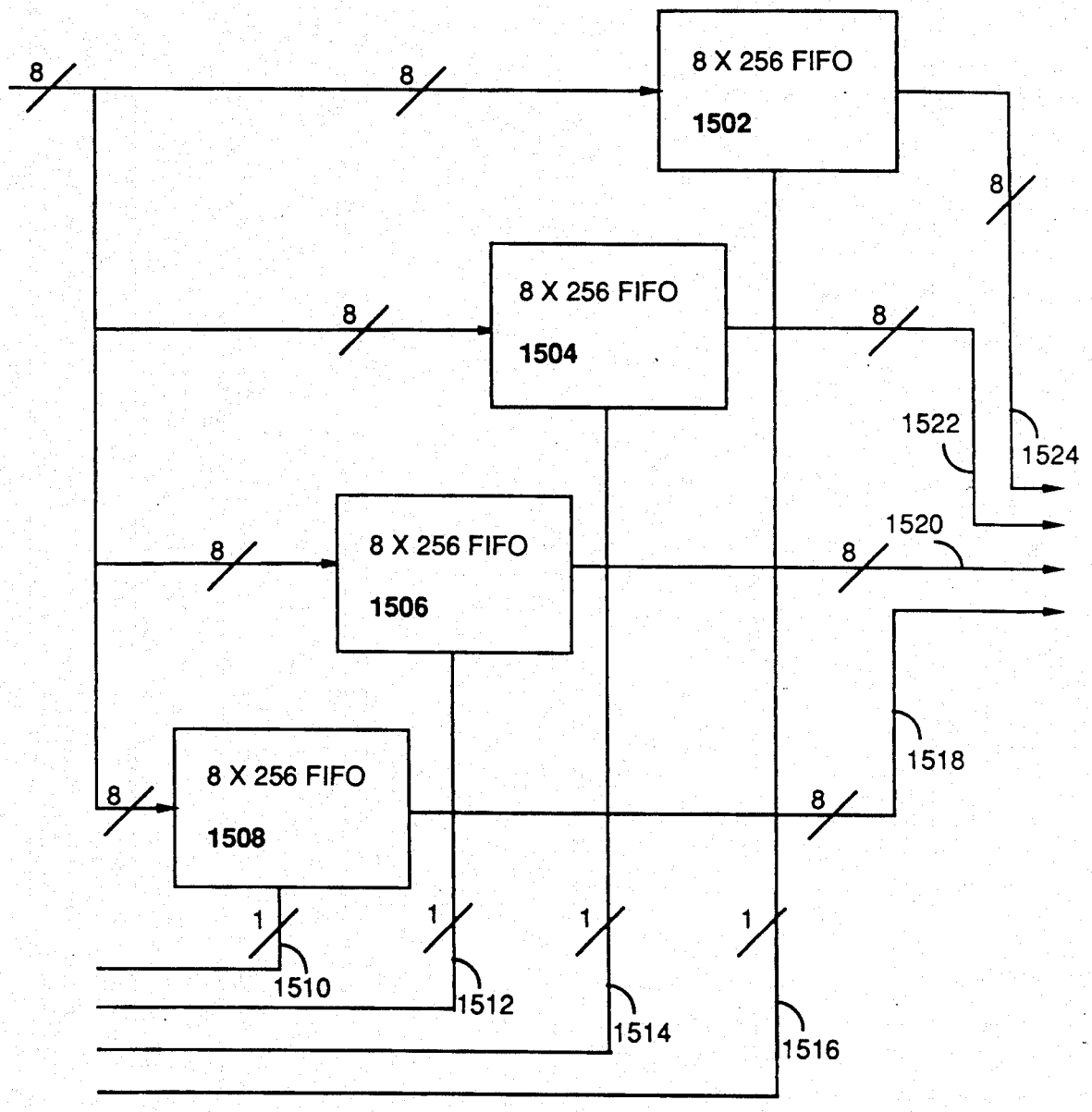
FIG. 15 is a more detailed diagram of the group of four 8 bit wide by 256 deep fifo buffers 912 shown in FIG. 9.

A more detailed diagram of the group of four fifo buffers 912 is illustrated in FIG. 15. Each of the four 8 bit wide×256 deep buffers 1502, 1504, 1506, 1508 receives at it's input a common 8 bits of data from 8 bit 4:1 mux 902. Each fifo receives one seperate bit of load enable data 1510, 1512, 1514, 1516 from the state machine 922. The outputs of the FIFOs, in parallel with the outputs from the other four groups 914, 916, 918 and 920 are connected to the 160 bit pixel data bus 118 (shown in FIGS. 1 and 8, and referred to as the "160 bit patch data bus" in FIGS. 9A and 9B). The outputs 1518, 1520, 1522, 1524 of the four Fifos form one column (4 pixels in the verticle direction) of the 5×4 patch on bus 160. Each fifo buffer in the group contibutes one pixel to the column. Groups 914, 916, 918 and 920 are similarly constructed. The outputs of each of these groups respectively forms a different column (4 pixels in the verticle direction) of the 5×4 patch.

In operation, the five multiplexers route data to five of the 20 fifo buffers. The group of five fifos is used to store a complete input line of data. As each 32 bit word is loaded into the fifos, only four out the five fifos are loaded. The state machine 922 is used to provide and control the select inputs of the multiplexers and the load enable inputs of the fifos. Each time a 32 bit input word is received, the multiplexers route the four input bytes to four of the five fifo buffers in the current line, (one of the fifos is not write enabled). The combination of routing and write enabling will repetitively cycle for every five 32 bit values received.

When four complete lines have been stored, the outputs of all 20 fifo buffers are read in parallel by the graphics processor so as to form the 160 bit pixel data bus.

The purpose behind this particular circuit is more apparent when one considers the structure of a 32 bit I/O word as against the structure of a patch. Assume a 32 bit I/O word contains four eight bit pixels—A0, B0, C0, D0. The incoming data will arrive at the crossbar converter as a stream such as:

A0,B0,C0,D0 A1,B1,C1,D1 A2,B2,C2,D2 . . .
Ax,Bx,Cx,Dx

This I/O data is in raster format. In other words the data arrives in the proper order to form a series of complete horizontal scan lines across the monitor. In a typical high resolution bit mapped monitor, a total of 1280 bytes (i.e. 320, 32 bit words) are used to display one complete horizontal scan line.

The problem with the format of the 32 bit I/O data will become clear when one considers the geometry of a patch. In the preferred organization of a patch, there are 5×4 eight bit pixels (i.e. 160 bits). In a patch access system, (such as the preferred embodiment of the present system), data is typically passed along the pixel data bus organized into such groups. In order to be consistent with the organization of the systems pixel data, the 32 bit raster scanned format must be converted into patch format. Doing this typically requires collecting four complete rows of raster scan formatted data from the I/O device, before outputting patch data from the crossbar converter. Data can then be output on the pixel data bus one patch at a time, making full use of the available bandwidth of the pixel data bus.

For efficient buffering it is preferable that the 20 fifo buffers are large enough to hold two complete patch rows. This allows one completely formed row to be read in an uninterrupted access by the graphics processor, whilst simultaneously inputting the next patch row from the crossbar convertor.

The preferred embodiment uses 512 word deep fifo's, so 2 complete rows of patches can be stored, enabling double buffering techniques to be used. That is to say, there are 256, 5×4 patches worth of data displayed horizontally across a typical high resolution monitor. Advantageously, this allows for the input data rate to be slower than the rate at which the graphics processor 100 can transfer data over the 160 bit pixel data bus 118. In this case the processor will spend the minimal time possible transferring grabbed data, the rest of the time is available for other processing tasks. In order to prevent the graphics processor from having to poll the crossbar convertor 800 to determine when a patch row is available for transfer, it is preferred that the graphics processor 100 can be interrupted by the crossbar convertor 800 when a patch row is available.

In cases where the I/O controller outputs data in an interlaced raster format, then it is required that the presently preferred embodiment of the crossbar converter collect only two lines (from the four line series), before outputting patches on the pixel data bus. This requires that the graphics processor 100 has the ability to perform masked pixel writes (i.e. the ability to overwrite only a selected portion of a stored patch).

To output data from the off screen or refresh memories, the sequence can be reversed. Patch data is loaded into an output set of fifos as it arrives on the pixel data bus. Under control of a state machine, multiplexers can then be used to format the patches into a 32 bit wide data stream.

Where the state machine 922 is a RAM, it may be programmed by the graphics processor prior to the beginning of the data transfer cycle. Where the conversion algorithm is to stay constant, the state machine RAM may be initialized during system start up or a Read Only Memory (ROM) may be utilized.

Figure 12:
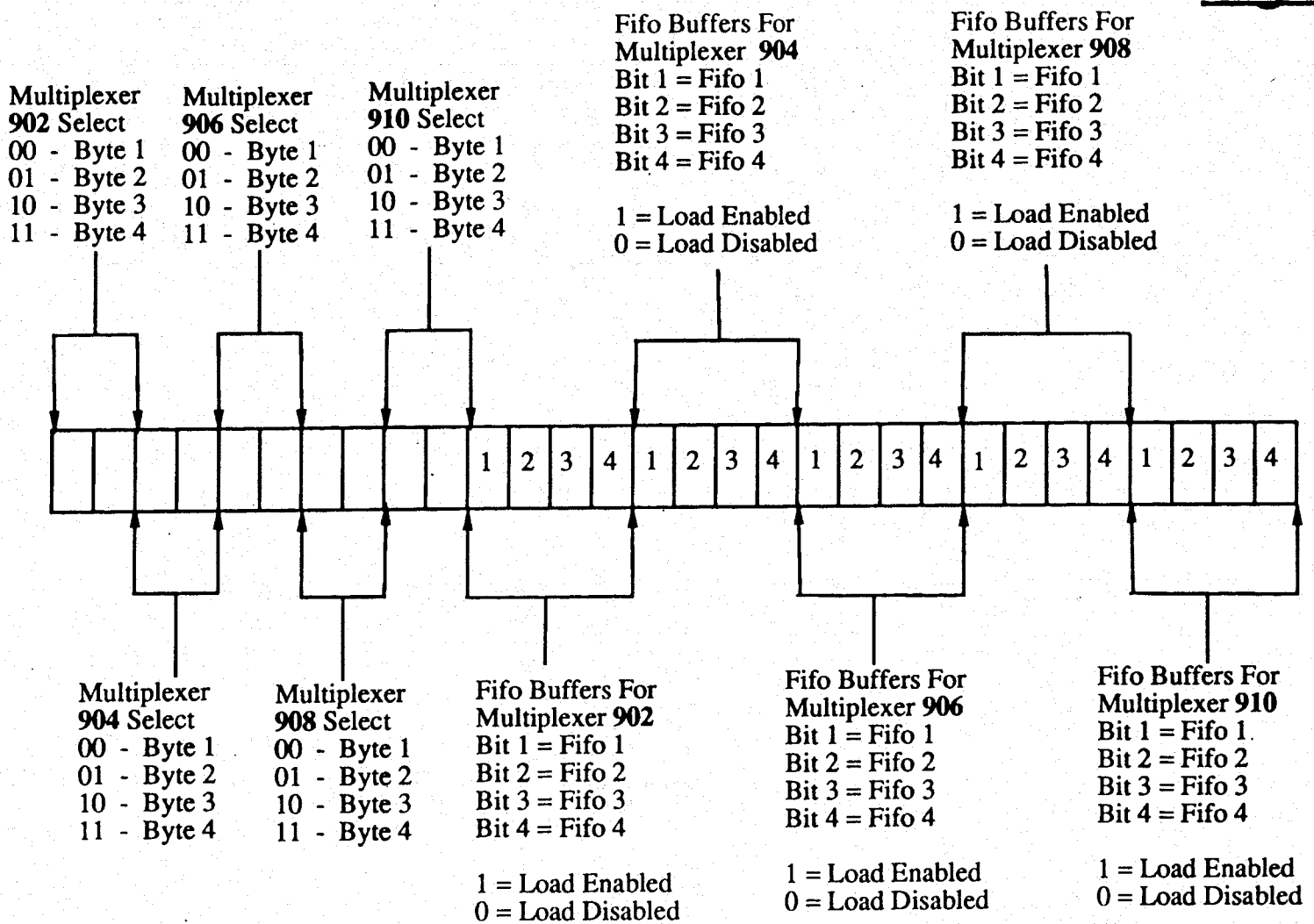
FIG. 12 shows the presently preferred format of the control data for the crossbar converter 800 of the present invention where a RAM or ROM is used as the state machine.

FIG. 12 shows one possible format for the control words within a state machine RAM or ROM 922. Five 2 bit fields are used to provide the select bits to each of the multiplexers 902, 904, 906, 908, 910. Five 4 bit fields are used to provide the load enable bit to each of the four fifos associated with each multiplexer.

Table 1-1 (below) is an example of how the control words using this format could be set up to acquire and format patch data (5×4 arrays of eight bit pixels) from four horizontal scan lines worth of non interlaced 32 bit parallel input I/O pixel data (the example of table 1-1 assumes a conventional 1280×1024 high resolution monitor, i.e. 1280 pixels per line).

TABLE 1-1

XX = Don't Care — 0's indicate where fifos are disabled

| word number | MUX control Byte Select | Fifo Load Control |
|---|---|---|
| 0001 | 00011011XX | 10001000100010000000 |
| 0002 | 011011XX00 | 10001000100000001000 |
| 0003 | 1011XX0001 | 10001000000010001000 |
| 0004 | 11XX000110 | 10000000100010001000 |
| 0005 | XX00011011 | 00001000100010001000 |

TABLE 1-1-continued

XX = Don't Care — 0's indicate where fifos are disabled

| word number | MUX control Byte Select | Fifo Load Control |
|---|---|---|
| sequence above (0001-0005) repeat through word number 320 | | |
| which completes a first full scan lines worth of pixel data. | | |
| (second scan line starts below) | | |
| 0321 | 00011011XX | 01000100010001000000 |
| 0322 | 011011XX00 | 01000100010000000100 |
| 0323 | 1011XX0001 | 01000100000001000100 |
| 0324 | 11XX000110 | 01000000010001000100 |
| 0325 | XX00011011 | 00000100010001000100 |
| sequence above (0321-0325) repeats through word number 640 | | |
| which completes a second full scan lines worth of pixel data. | | |
| (third scan line starts below) | | |
| 0641 | 00011011XX | 00100010001000100000 |
| 0642 | 011011XX00 | 00100010001000000010 |
| 0643 | 1011XX0001 | 00100010000000100010 |
| 0644 | 11XX000110 | 00100000001000100010 |
| 0645 | XX00011011 | 00000010001000100010 |
| sequence above (0641-0645) repeats through word number 960 | | |
| which completes a third full scan lines worth of pixel data. | | |
| (fourth scan line starts below) | | |
| 0961 | 00011011XX | 00010001000100010000 |
| 0962 | 011011XX00 | 00010001000100000001 |
| 0963 | 1011XX0001 | 00010001000000010001 |
| 0964 | 11XX000110 | 00010000000100010001 |
| 0965 | XX00011011 | 00000001000100010001 |
| sequence above (0961-0965) repeats through word number 1280 | | |
| which completes a third full scan lines worth of pixel data. | | |

After word 1280 has been stored, one complete row of 5×4 patches of eight bit pixels can now be processed. The sequence above would be repeated for every four lines worth of 32 bit I/O data.

From table 1—1 it can be understood that in order to read out complete patches, the graphics processor 100 reads the 20 fifo's in parallel. In as much as the pixel data has been stored in first in/first out fashion, the patches will naturally be accessed in sequential order, as they would appear horizontally across the display screen.

The graphics processor 100 can read the fifos by simply using a predefined control line to simultaneously operate the read lines of all the fifos. The preferred fifo chips (IDT 7201 fifos available from IDT of California, U.S.A..) have a flag that indicates when they are half full (256 words stored), and another flag that indicates that they are completely full (512 words stored). These flags can be used to interrupt the graphics processor 100 to let it know that it is time to start reading complete patches. Typically the processor would be interrupted when the fifos are half full, (this meaning that there are at least 256 patches to be read, and yet another 256 patches could be accepted from the crossbar convertor before the fifos overflow). Normally, the half full flag from one fifo in the bottom row of five fifos would be used to form the interrupt as this is the last row to be loaded from the convertor. The fifos can be read and written to simultaneously.

Because the the fifos are 512 words deep, up to two complete screen rows of patches can be stored, allowing double buffering techniques to be implemented. Advantageously, the storage of complete rows of patches in the fifo's allows the graphics processor 100 to read patches in page mode (as opposed to slower non page addressing). This can considerably speed up the data transfer rate. Also, because the input data can be transferred in large groups of pixels from the fifo buffers, the processor overhead of reading pixel data in an interrupt routine is reduced.

Alternative arrangements of crossbar switching can include four 4 to 1 multiplexers to allow input of data presented in a raster pattern where successive pixels follow in a column rather than a row. Alternatively, a 4 to 1 multiplexer on every fifo input, with sufficient control from the state machine, would allow input of data in a vertical or horizontal raster format. This functionality can also be achieved by four 4 to 1 multiplexers followed by five 4 to 1 multiplexers.

The crossbar converter's design may be easily modified so as to convert any width data stream into patch format.

e. Conclusion

Many modifications will now occur to those skilled in the art. For example, more than one off screen memory may be used. Also, the arbitrary shape clipper could be used on an off screen memory. Those skilled in the art will now also recognize that the off screen memory, and the arbitrary shape clipper can be combined to form a powerful processing tool, For example, image data may be clipped as it is copied from the off screen memory to the screen refresh memory. Further, putting I/O data on the pixel data bus (via the cross bar converter, for èxample) a real time image can be clipped enroute to the screen refresh memory. Also, the cross bar converter can be adapted to convert words of other sized (e.g. 16 bits, 64 bits, 128 bits) into a variety of patch geometries other than the preferred 5×4×8.

Therefore, while the preferred embodiments have been described, they should not be considered as limitations on the invention but only exemplary thereof.

APPENDIX A

Parts List for Discrete Components

Screen Refresh Memory (102),
video RAMS
Hitachi HM53462

Off Screen Memory (104),
dynamic RAMs
TI TMS4256 (256K×1)

"AND" gate (114)
TI 74AS08

X offset register (502)
Y offset Register (504)
N-way 2:1 Multiplexer (506)
2 AMD 29520 Multilevel pipeline registers Adder (508), Subtractor 1304
TI 74AS181 (3 each)

8 bit latch (702)
TI 74AS374

8 bit latch (704)
AMD 29845

Static RAMs (708,710, 712,714,716,718,720,722)
IDT 7187

Address generator (108)
TI 74AS269, AMD 16R4B per X or Y counter.

ASC (112), support PAL
AMD 16L8B

APPENDIX B

Glossary of Output Control and Data Signals Preferably Provided by the Graphics Processor 100 to the present system.

| | |
|---|---|
| Address Data | 12 Bits X, 12 Bits Y on Address Data Bus 116 |
| Pixel Data Patch Formatted | 160 bits wide, 5 X4 on Pixel Data Bus 120 (8 bit pixels) |
| Read Enables (124,126) | 1 bit for each screen refresh and off screen memory. Used to read enable any one of the memories at a given time. |
| Write Enables (122,120) | 1 bit for each memory. Used to write enable the memories. |
| Read Control | 1 bit. Used to read pixel data from the currently enabled memory. |
| Write Control | 1 bit, used to write pixel data to the write enabled memories. |
| X Offset Load Enable (510) | Used to load the X offset register with X offset data. |
| Y Offset Load Enable (512) | Used to load the X offset register with X offset data. |
| MUX Select (1410) | Used to control the offset MUX 506 and the readback MUX 1302 so as to select a given one of their inputs. |
| buffer enable (1408) | Enables buffer 1306 so as to put read-back data on the address data bus 116. |
| X Counter Load Enable (1008) | Used to load the Column Address Counters 1002, 1102 in the address generators. |
| Y Counter Load Enable (1010) | Used to load the Row Address Counters 1004 1104 in the address generators. |
| Row/Column Address Select 1010) | Used by the address generators multiplexers 1006, 1106 to alternately output Row and Column addresses to the framestores. (102,104). |
| ASC Control Lines | (Provided on ASC Control Bus 128) |
| 8 Bits of Chip Enable Data | Used by the ASC to chip enable one RAM for reading (clip mode) and to output disable eight RAMs for for writing in write mode. |
| 1 Clip/Write Mode Signal | Used to write enable all eight ASC RAMs in write mode and by an internal processor PAL 730 to qualify the chip select signals so as to not produce any chip enables while the ASC RAMS are write enabled (write mode). |
| 1 Time Pulse Signal | Used by an internal PAL 730 to insure that valid data is written to the ASC RAMs in write mode. |
| 8 ASC data bits (bus 726) | Used to program the eight ASC RAMs with bit mapped clip patterns. |

We claim:

1. A method for converting 32 bit (four byte) parallel data words of raster formatted pixel data consisting of a predetermined number of bytes, into a 160 bit, 2 dimensional patch format having an X dimension equal to five, one byte pixels and a Y dimension equal to four, one byte pixels comprising the steps of:

(A) storing each consecutive byte within a first horizontal scan line of the parallel data words of raster formatted pixel data into a first group of five fifo buffers, so that every group of five consecutive bytes is stored at a progressively deeper level into the fifos;

(B) storing each consecutive byte within a second horizontal scan line of the parallel data words of raster formatted pixel data into a second group of five fifo buffers, so that every group of five consecutive bytes is stored at a progressively deeper level into the fifos;

(C) storing each consecutive byte within a third horizontal scan line of the parallel data words of raster formatted pixel data into a third group of five fifo buffers, so that every group of five consecutive bytes is stored at a progressively deeper level into the fifos;

(D) storing each consecutive byte within a fourth horizontal scan line of the parallel data words of raster formatted pixel data into a fourth group of five fifo buffers, so that every group of five consecutive bytes is stored at a progressively deeper level into the fifos; and (E) accessing the pixel data within the four groups of five fifo buffers in parallel, first in first out fashion whereby the pixel data stored within the fifo buffers is accessed as consecutive patches across the horizontal scan direction of a display monitor.

2. The method of claim 1 wherein each of steps (A), (B), (C), and (D) comprises the step of storing the bytes within the groups of fifo buffers according to control information provided by a state machine.

3. The method of claim 1 wherein step (E) comprises the steps of:

(i) providing controlled information from a state machine; and (ii) accessing the pixel data within the four groups of five fifo buffers according to said control information provided by said state machine.

4. The method of claim 2 wherein said state machine is a random access memory.

5. The method of claim 4 wherein the random access memory is a read only memory.

6. The method of claim 2 further comprising the steps of:

storing, as step (E) is occurring, each consecutive byte within a fifth horizontal scan line of the parallel data words of raster formatted pixel data into a fifth group of five fifo buffers, so that every group of five consecutive bytes is stored at a progressively deeper level into the fifos.

7. A method for converting 160 bit (20 byte) parallel groups of pixel data organized into a 2 dimensional patch having four rows of five, one byte pixels, into 32 bit (four byte) parallel data words of raster formatted pixel data consisting of a predetermined number of bytes comprising the steps of:

(A) storing a series of 160 bit patches into a group of twenty, eight bit fifo buffers, so that the first row of each patch is in a first subgroup of five fifo buffers, the second row of each patch is in a second subgroup of five fifo buffers, the third row of each patch is in a third subgroup of five fifo buffers and the fourth row of each patch is in a fourth subgroup of fifo buffers whereby each patch is stored at a progressively deeper level into the fifos;

(B) accessing the pixel data within preselected fours of the first subgroup of five buffers in first in first out fasion, wherein pixel data representing a first horizontal scan line is first accessed in sequential groups of 32 bits;

(C) accessing the pixel data within preselected fours of the second subgroup of five buffers in first in first out fasion, wherein pixel data representing a second horizontal scan line is first accessed in sequential groups of 32 bits;

(D) accessing the pixel data within preselected fours of the third subgroup of five buffers in first in first out fasion, wherein pixel data representing a third horizontal scan line is first accessed in sequential groups of 32 bits;

(E) accessing the pixel data within preselected fours of the fourth subgroup of five buffers in first in first out fasion, wherein pixel data representing a fourth horizontal scan line is first accessed in sequential groups of 32 bits.

8. An imaging and graphics display system comprising:

a screen refresh memory;

an off screen memory;

a pixel data bus operable to provide 2 dimensional patch formatted image data flow between the screen refresh memory, the off screen memory, and a graphics processor;

means for providing memory addresses to the screen refresh memory and the off screen memory;

means for offsetting the addresses provided to the off screen memory, relative to the addresses provided to the refresh memory; and control means operable to enable data representing a given image to be simultaneously written to both the screen refresh memory and the off screen memory;

a cross bar converter means in communication with said pixel data bus for converting parallel image data into said patch formatted image data;

clipping means for providing clipping control data; and logic means responsive to said clipping control data to prevent said control means from writing data to said screen refresh menu.

9. A method of converting raster-formatted pixel data into patch-formatted pixel data, the raster formatted data being provided as parallel words each representing a plurality of pixels, and the patch-formatted data being provided as parallel words each representing a patch of pixels dimensioned X pixels by Y pixels, the method comprising the steps of:

(A) providing a plurality of buffers equal in number to the number of pixels in the patch;

(B) distributing the raster formatted pixel data for Y raster scan lines over the buffers so that for any given position the data at that position in all of the buffers belongs to the same patch; and (C) reading the data from said buffers in parallel fashion.

* * * * *